US008322969B1

(12) United States Patent
Westendorf et al.

(10) Patent No.: US 8,322,969 B1
(45) Date of Patent: Dec. 4, 2012

(54) LOADER ASSEMBLY AND METHOD PROVIDING FOR CANTILEVERED STORAGE OF LIFT ARMS

(75) Inventors: Neal W. Westendorf, Dakota Dunes, SD (US); Joseph W. Langenfeld, Onawa, IA (US)

(73) Assignee: Westendorf Manufacturing, Co., Onawa, IA (US)

( * ) Notice: Subject to any disclaimer, the term of this patent is extended or adjusted under 35 U.S.C. 154(b) by 533 days.

(21) Appl. No.: 12/557,127

(22) Filed: Sep. 10, 2009

(51) Int. Cl.
*B66C 23/00* (2006.01)

(52) U.S. Cl. ..... 414/686; 172/274; 172/817

(58) Field of Classification Search ..... 414/686, 414/723; 172/272–275, 817; 37/403, 408, 37/409, 410, 442, 443, 444, 468, 466
See application file for complete search history.

(56) References Cited

U.S. PATENT DOCUMENTS

| | | | | |
|---|---|---|---|---|
| 2,326,338 | A | 8/1943 | Drott | 37/409 |
| 2,812,595 | A | 11/1957 | Houghton | 37/409 |
| 3,077,999 | A | 2/1963 | James | 37/409 |
| 3,209,474 | A | 10/1965 | Artman | 37/409 |
| 3,243,905 | A | 4/1966 | Ulrich | 37/406 |
| 3,344,540 | A | 10/1967 | Ulrich | 37/406 |
| 3,455,477 | A | 7/1969 | Blair | 414/704 |
| 3,512,665 | A | 5/1970 | Westendorf | 414/723 |
| 3,701,443 | A | 10/1972 | Lely | 414/546 |
| 3,805,980 | A | 4/1974 | Kisaka | 414/686 |
| 3,833,136 | A | 9/1974 | Spicer | 414/686 |
| 3,863,786 | A | 2/1975 | Frank | 414/686 |
| 3,892,322 | A | 7/1975 | Drennhaus | 414/686 |
| 3,912,095 | A | 10/1975 | Miller | 414/686 |
| 3,939,997 | A | 2/1976 | Frank | 414/686 |
| 3,991,890 | A | 11/1976 | Frank | 414/686 |
| 4,033,469 | A | 7/1977 | Frank | 414/686 |
| 4,051,962 | A | 10/1977 | Westendorf | 414/686 |
| 4,065,009 | A | 12/1977 | Old | 414/686 |
| 4,085,856 | A | 4/1978 | Westendorf | 414/723 |
| 4,247,242 | A | 1/1981 | Goertzen | 414/686 |
| 4,257,730 | A | 3/1981 | Kawakita | 414/686 |
| 4,275,984 | A | 6/1981 | Lenertz | 414/686 |
| 4,345,870 | A | 8/1982 | Anderson | 414/686 |
| 4,347,031 | A | 8/1982 | Friesen | 414/686 |
| 4,470,751 | A | 9/1984 | Masuzawa | 414/686 |
| 4,498,839 | A | 2/1985 | Williams | 414/686 |
| 4,522,554 | A | 6/1985 | Williams | 414/686 |
| 4,538,955 | A | 9/1985 | Langenfeld | 414/686 |
| 4,565,484 | A | 1/1986 | Hamada | 414/686 |
| 4,565,485 | A | 1/1986 | Wilman | 414/704 |

(Continued)

FOREIGN PATENT DOCUMENTS

WO WO 2006/100823 * 9/2006

*Primary Examiner* — Donald Underwood
(74) *Attorney, Agent, or Firm* — Dowell IP, P.C.

(57) ABSTRACT

The front end loader and method of the present invention provides front end loader lift arms that may be removed from an implement, such as a bucket, and secured to the bucket in a cantilevered position for storage of the lift arms. Connections on the implement and lift arms allow the lift arms to be securely interconnected with connections on the bucket without the use of tools or pins so that the center of gravity of the lift arms is above the bucket. The lift arms may then be removed from a utility vehicle. In this storage position, the lift arms are stored and maintained in a secure position so that they may later be easily and quickly reattached to the utility vehicle.

31 Claims, 26 Drawing Sheets

U.S. PATENT DOCUMENTS

| | | | | |
|---|---|---|---|---|
| 4,566,844 | A | 1/1986 | Campin | 414/726 |
| 4,606,692 | A | 8/1986 | Langenfeld | 414/686 |
| 4,787,811 | A | 11/1988 | Langenfeld | 414/723 |
| 4,790,084 | A | 12/1988 | Anderson | 37/403 |
| 4,797,051 | A | 1/1989 | Langenfeld | 414/686 |
| 4,859,130 | A | 8/1989 | Langenfeld | 414/703 |
| 4,890,400 | A | 1/1990 | Long | 37/241 |
| 4,915,575 | A | 4/1990 | Langenfeld | 414/703 |
| 4,930,974 | A | 6/1990 | Langenfeld | 414/631 |
| 4,968,213 | A | 11/1990 | Langenfeld | 414/686 |
| 4,995,760 | A | 2/1991 | Probst | 404/119 |
| 5,121,557 | A | 6/1992 | Moore | 37/406 |
| 5,129,780 | A | 7/1992 | Stumpe | 414/686 |
| 5,135,347 | A | 8/1992 | Kaczmarczyk | 414/686 |
| 5,232,330 | A | 8/1993 | Rae | 414/686 |
| 5,240,367 | A | 8/1993 | Nakamura | 414/815 |
| 5,387,076 | A | 2/1995 | Fuzzen | 414/686 |
| 5,466,113 | A | 11/1995 | Norberg | 414/723 |
| 5,531,561 | A | 7/1996 | Rae | 414/686 |
| 5,540,289 | A | 7/1996 | Hirooka | 172/274 |
| 5,785,328 | A | 7/1998 | Eckloff | 280/33.998 |
| 5,895,199 | A | 4/1999 | Baumert, III | 414/686 |
| 5,997,237 | A | 12/1999 | Langenfeld | 414/723 |
| 6,035,941 | A | 3/2000 | Hirooka | 172/274 |
| 6,142,724 | A | 11/2000 | Hirooka | 414/686 |
| 6,231,295 | B1 | 5/2001 | Girstenbrei | 414/686 |
| 6,247,888 | B1 | 6/2001 | Guiet | 414/686 |
| 6,386,821 | B1 | 5/2002 | Schneider | 414/686 |
| 6,582,177 | B1 | 6/2003 | Westendorf | 414/686 |
| 6,663,337 | B2 | 12/2003 | Westendorf | 414/685 |
| 6,986,634 | B2 | 1/2006 | Westendorf | 414/686 |
| 6,994,511 | B2 | 2/2006 | Westendorf | 414/686 |
| 7,172,384 | B1 | 2/2007 | Westendorf | 414/686 |
| 2008/0003090 | A1 | 1/2008 | Kim | 414/686 |

* cited by examiner

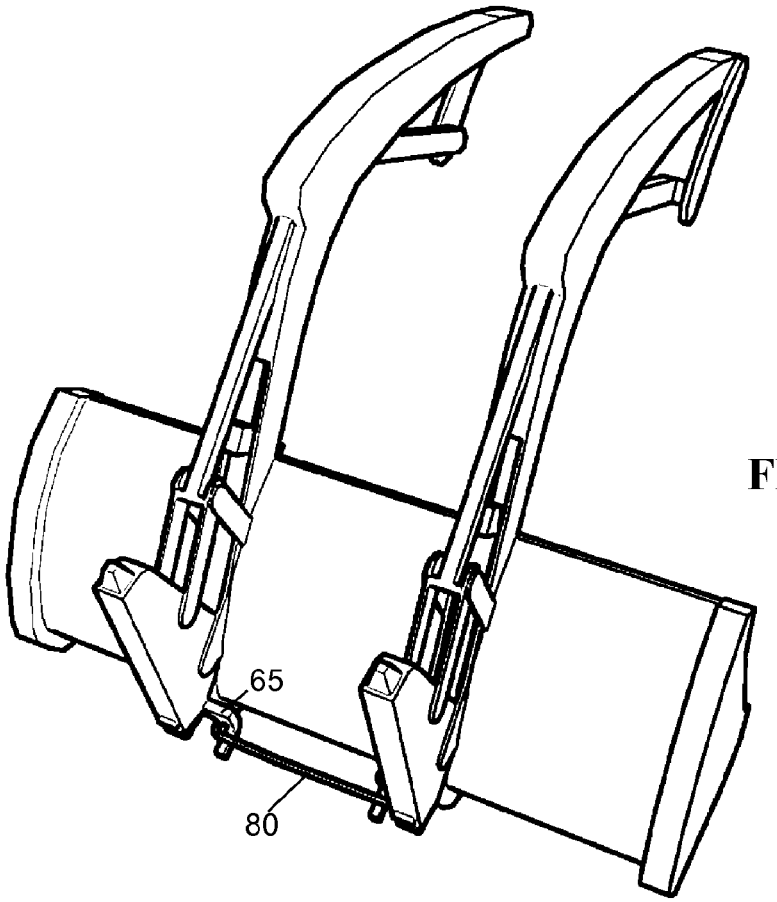
FIG. 15
FIG. 16
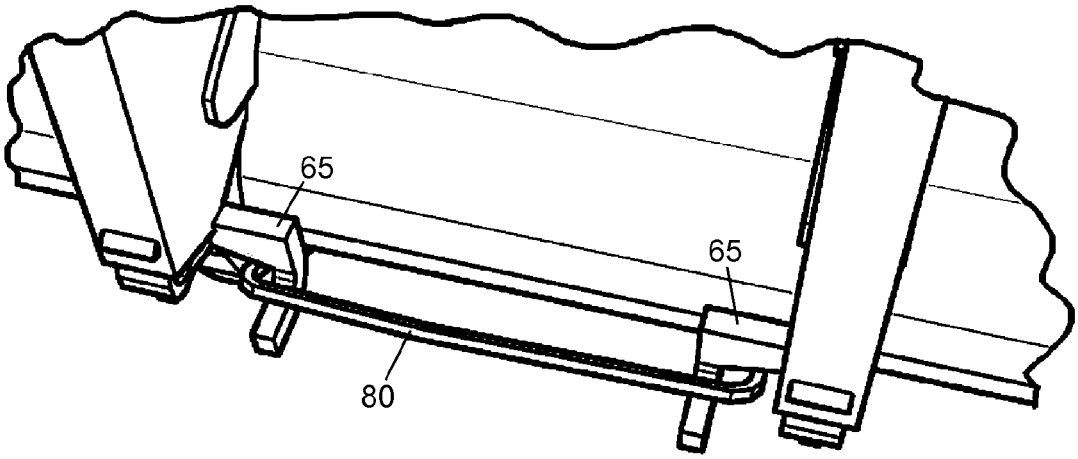

FIG. 17
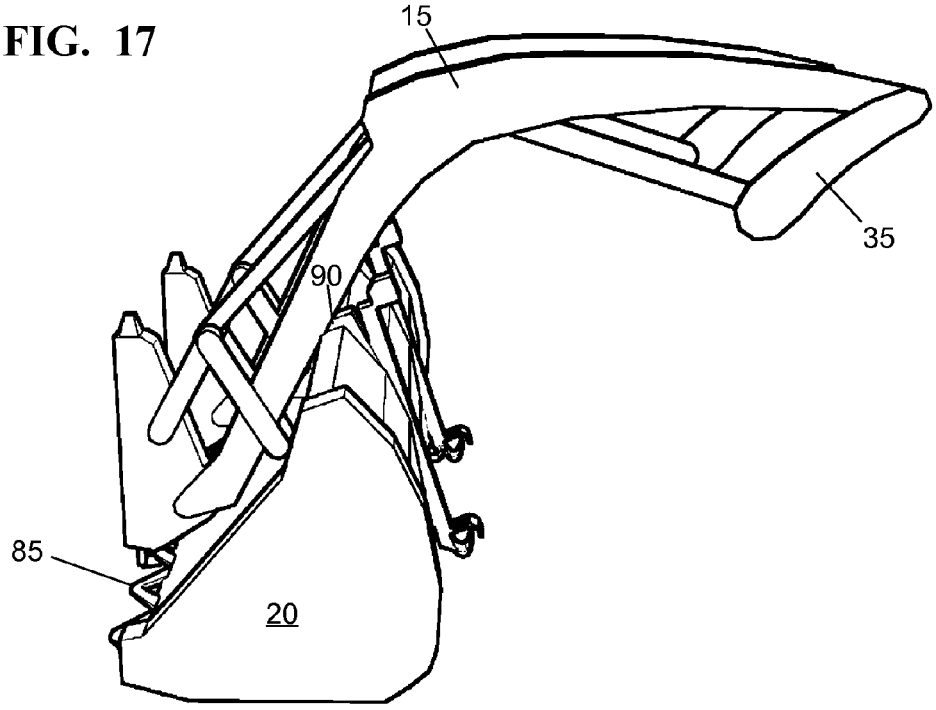
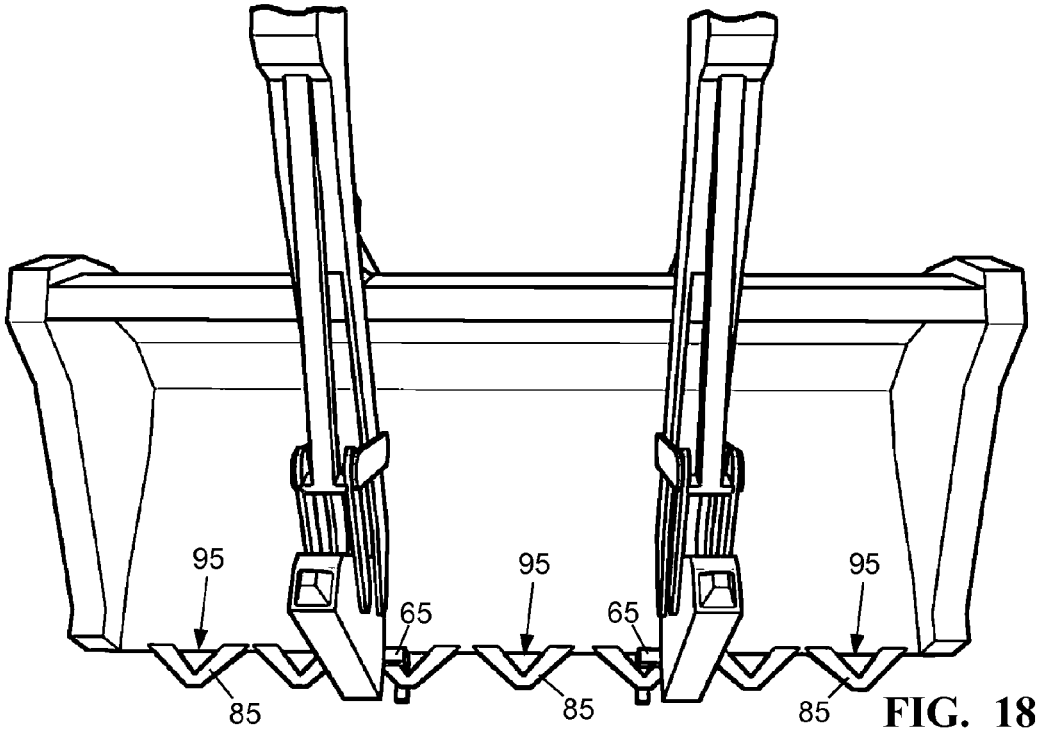
FIG. 18

FIG. 19
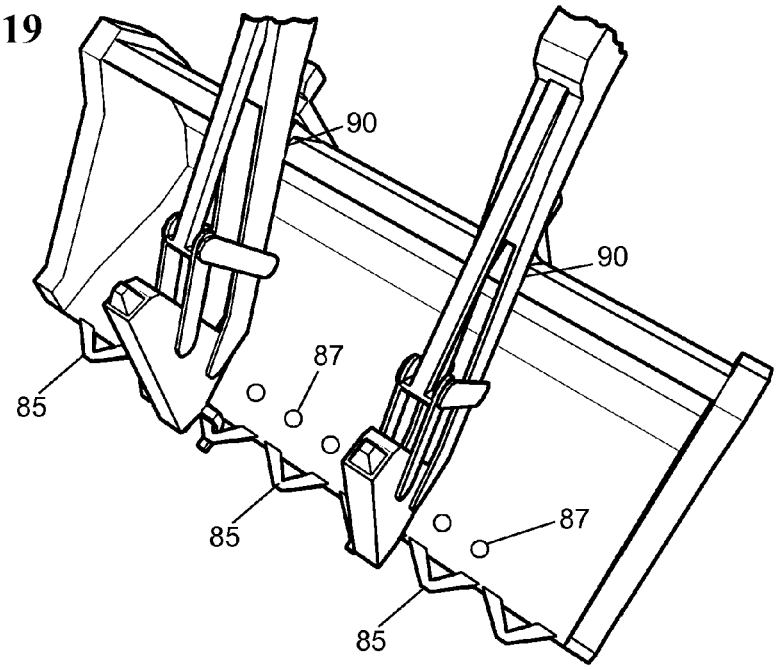
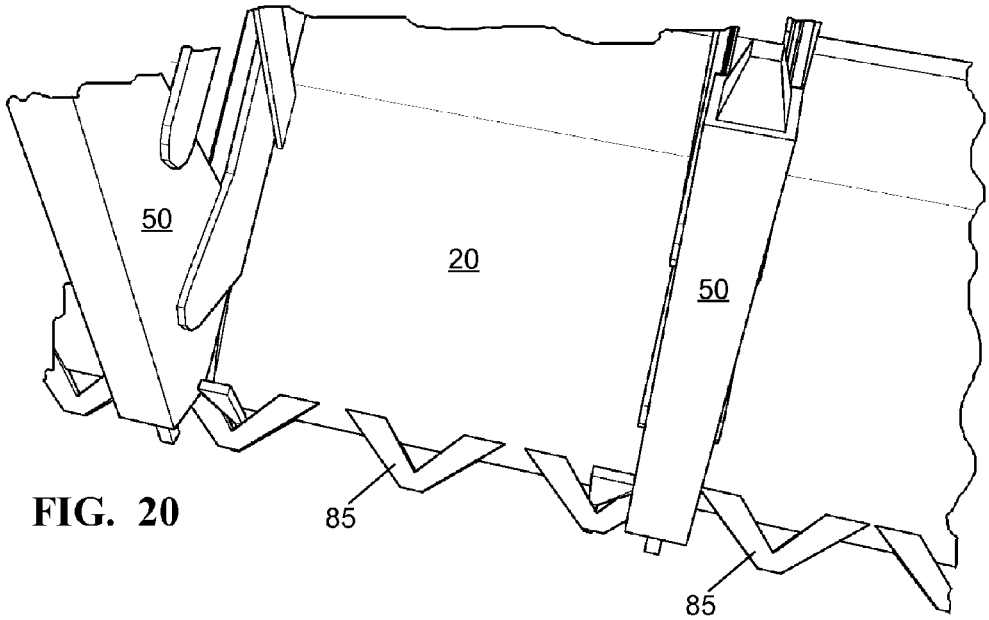
FIG. 20

FIG. 23
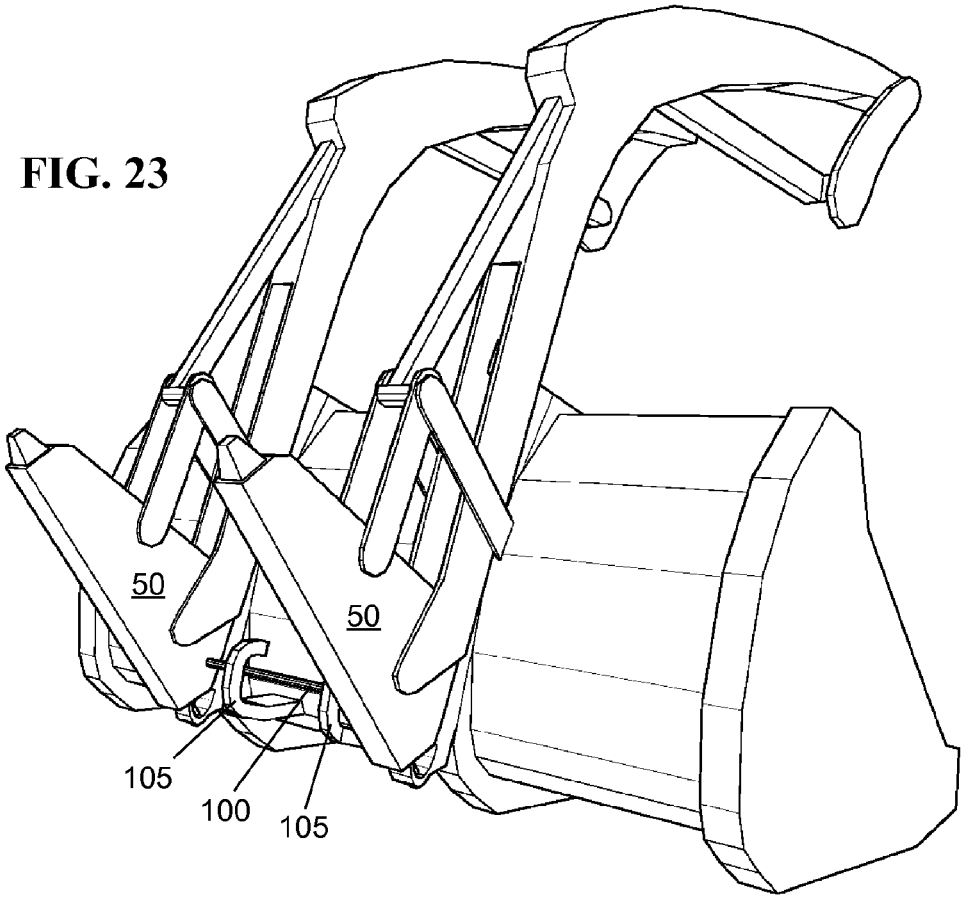
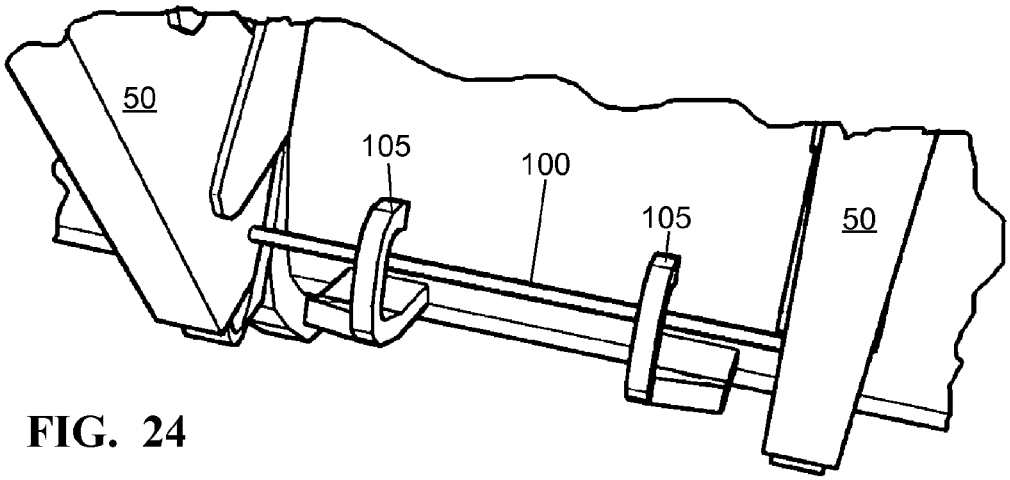
FIG. 24

FIG. 25
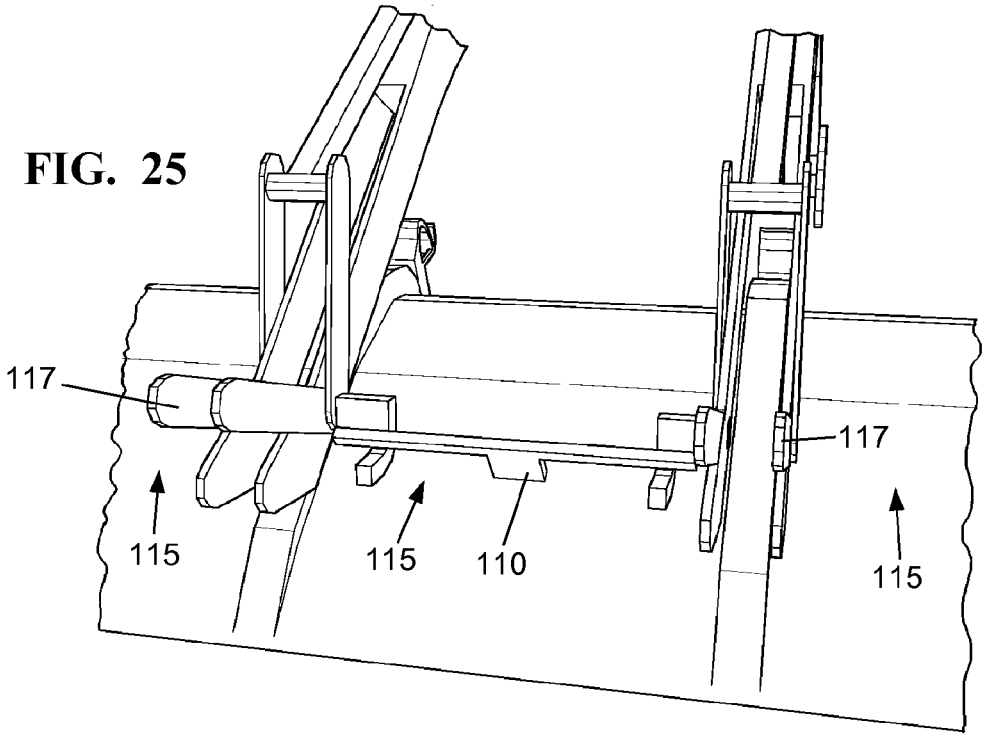
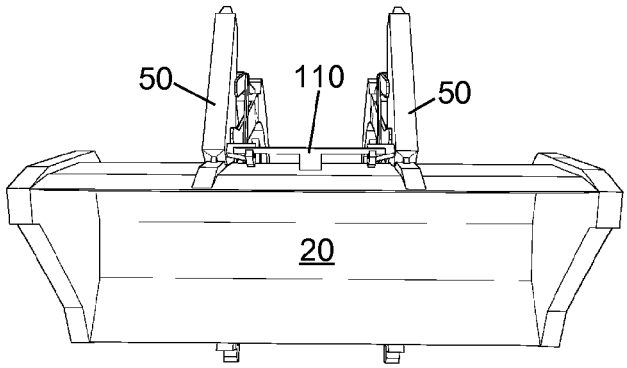
FIG. 26
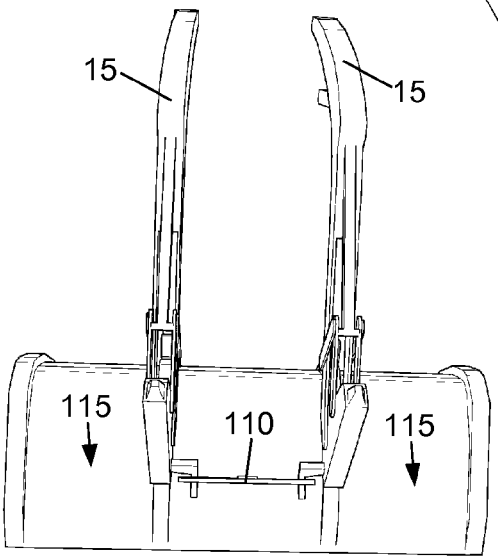
FIG. 27

FIG. 29
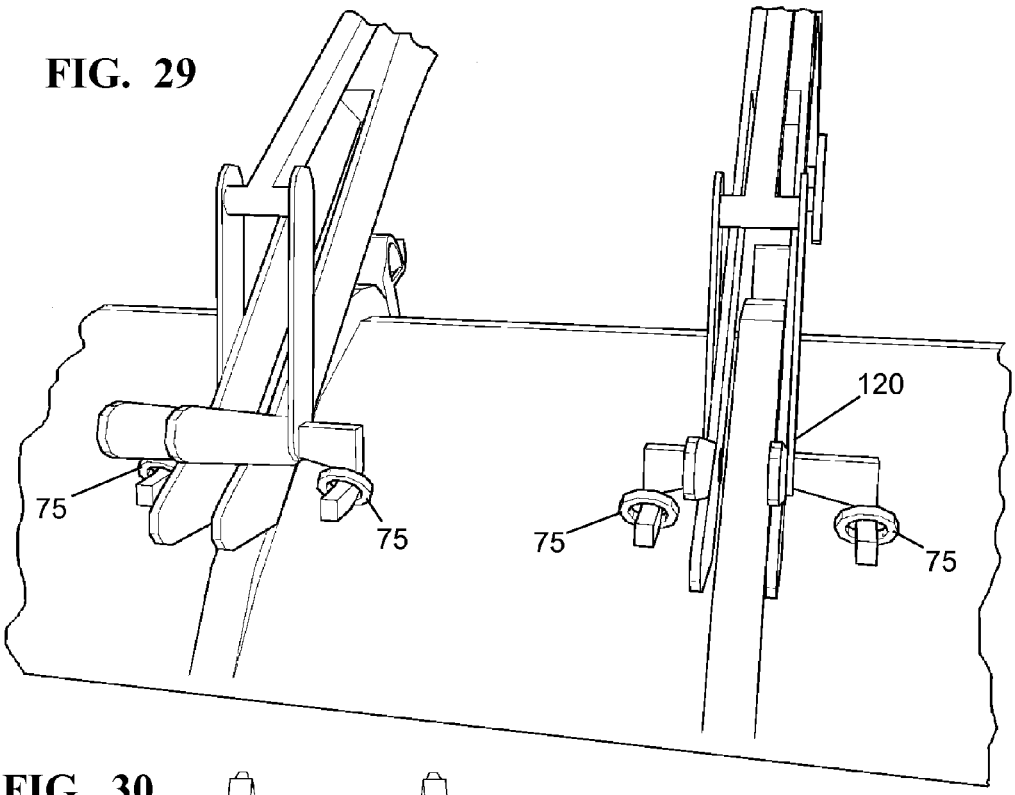
FIG. 30
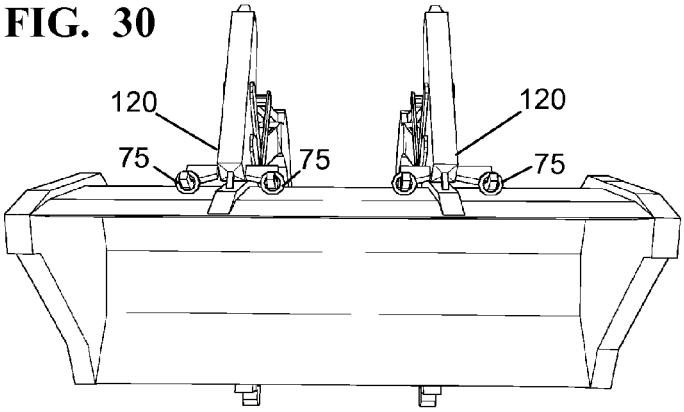
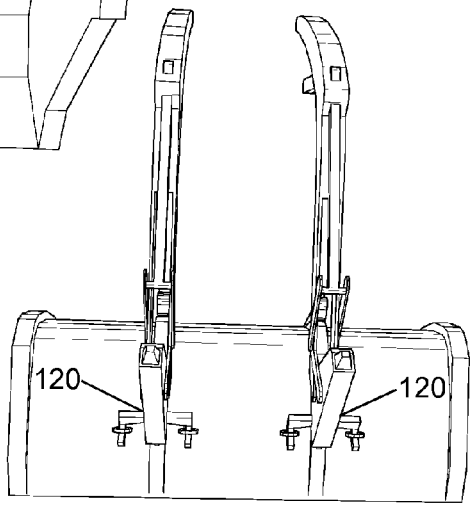
FIG. 31

FIG. 35
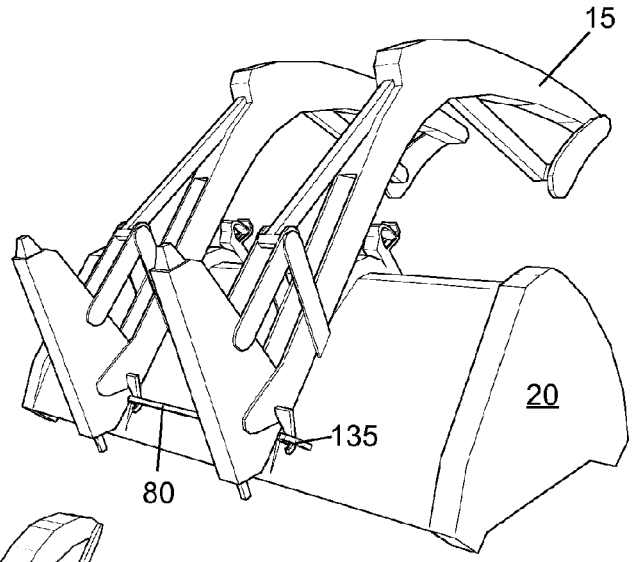
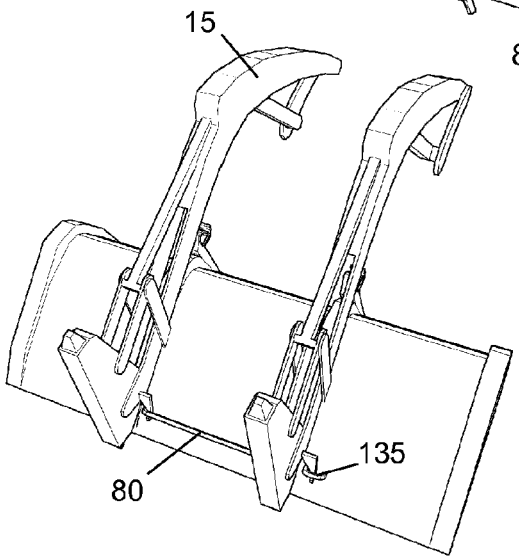
FIG. 36
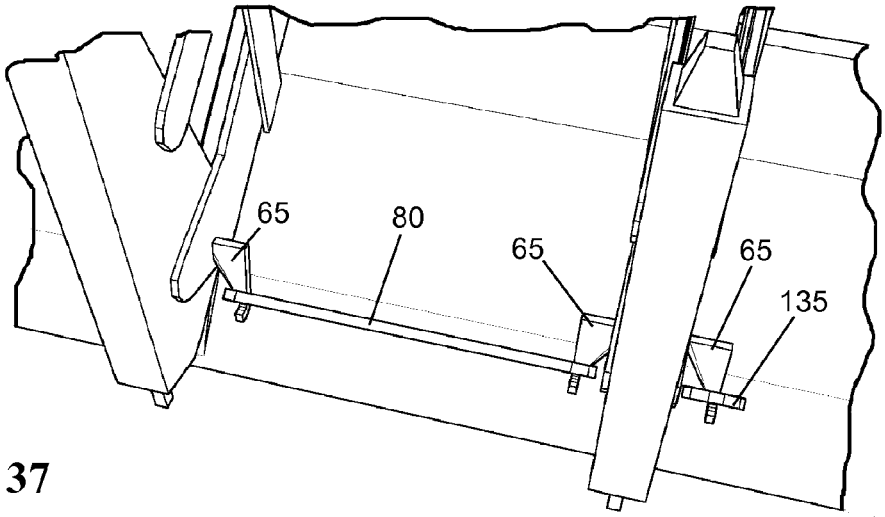
FIG. 37

FIG. 40
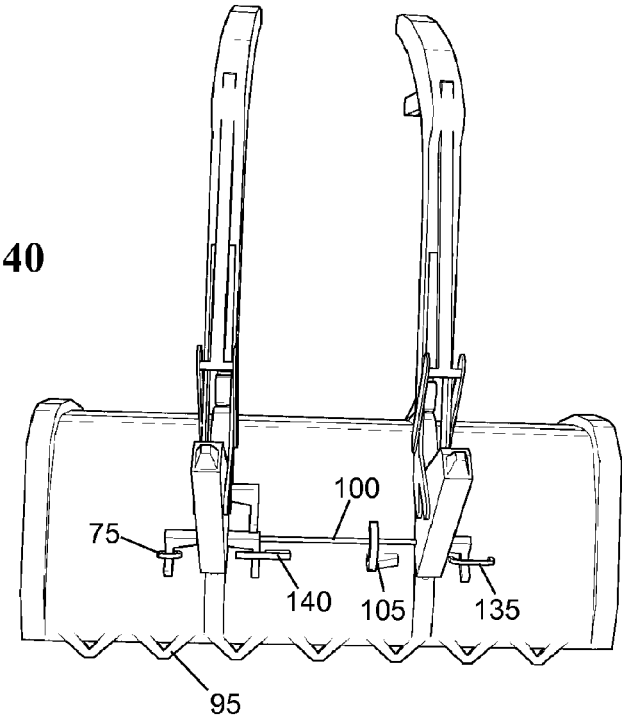
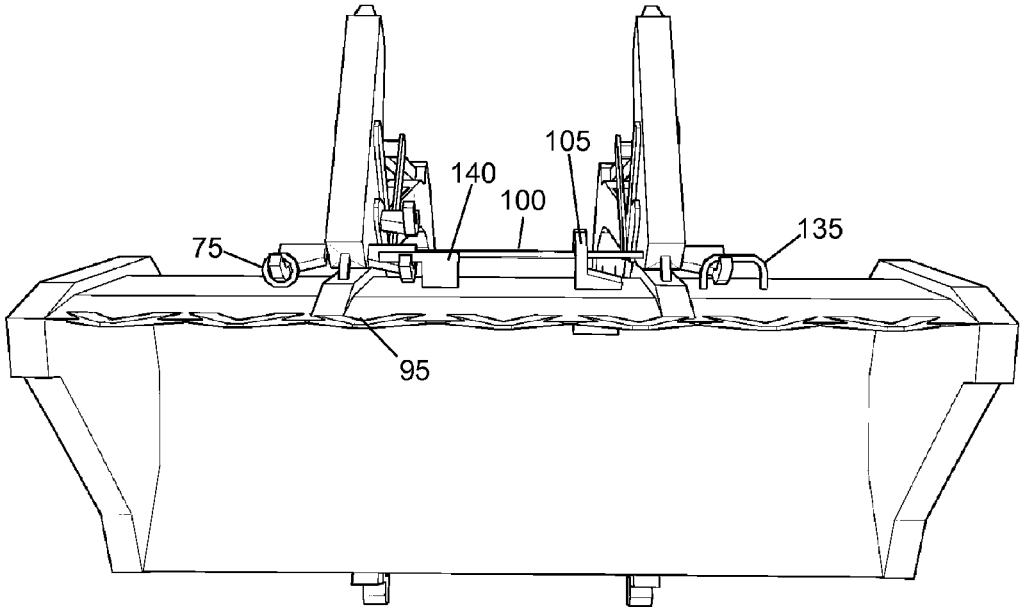
FIG. 41

FIG. 56
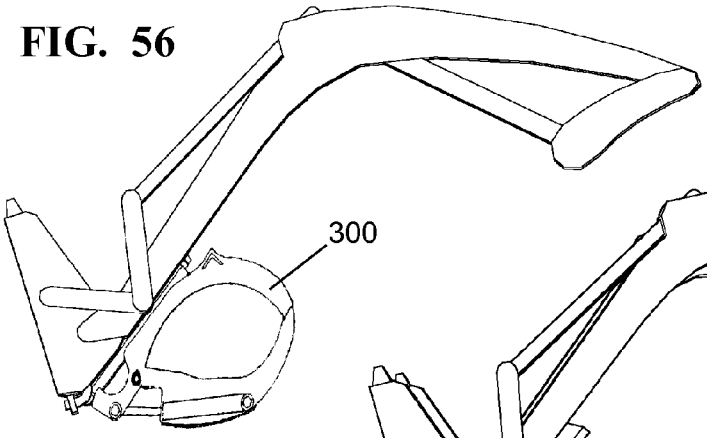
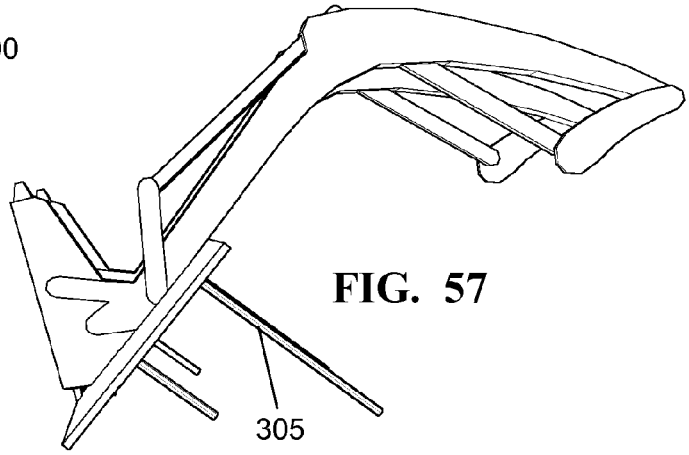
FIG. 57
FIG. 58
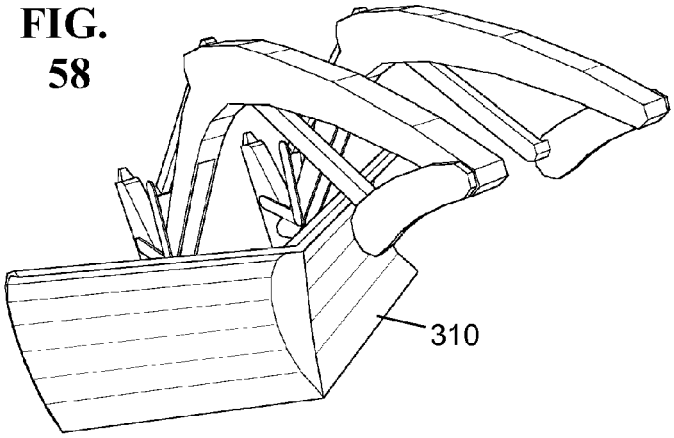
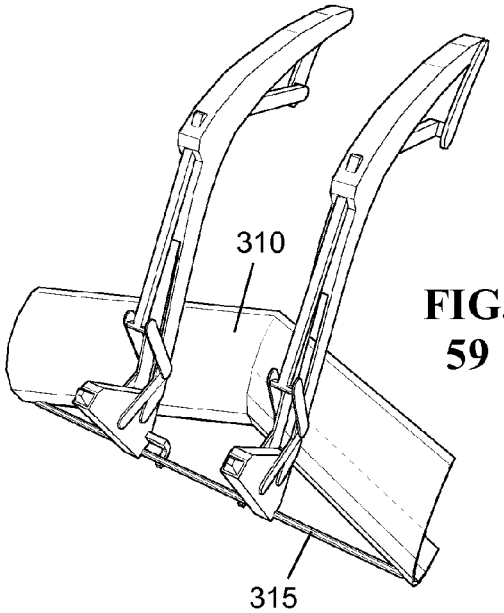
FIG. 59
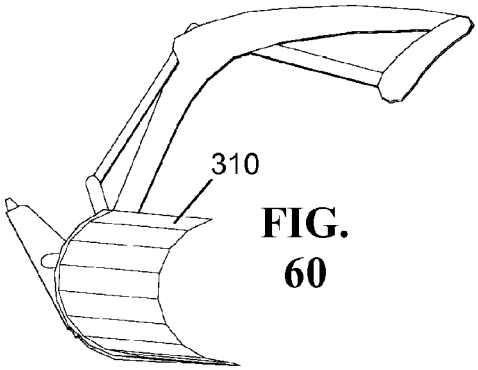
FIG. 60

FIG. 61
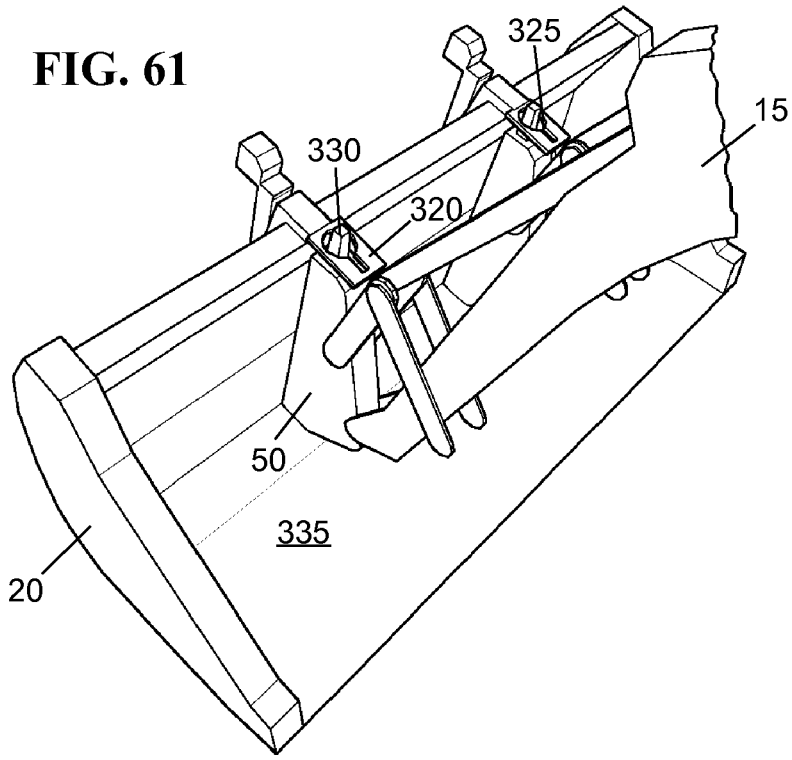
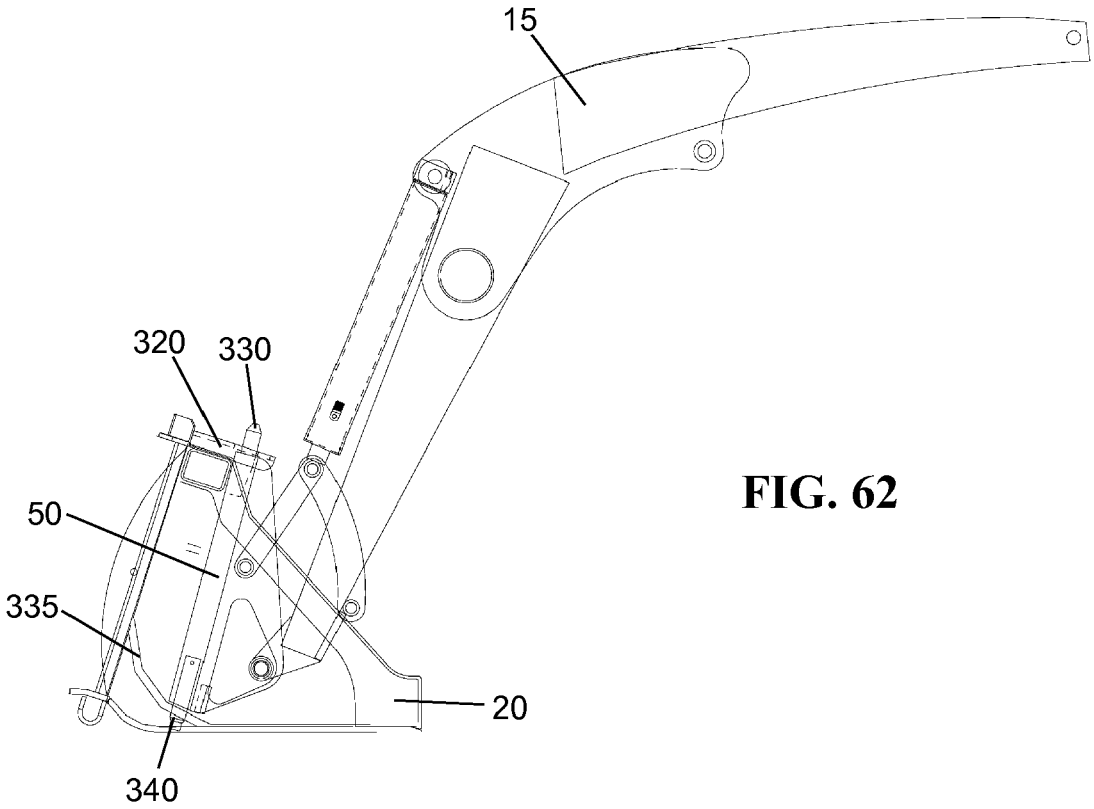
FIG. 62

LOADER ASSEMBLY AND METHOD PROVIDING FOR CANTILEVERED STORAGE OF LIFT ARMS

FIELD OF THE INVENTION

The present invention relates generally to a configuration for a loader assembly for a utility vehicle, and a method for detaching and storing the loader assembly, that allows for the loader assembly to be easily and safely detached from the utility vehicle and stored on a bucket or other implement in a cantilevered position.

BACKGROUND OF THE INVENTION

Tractors are a common utility vehicle in the farming, construction and landscaping industries. The key benefit of these vehicles is their great versatility. Unlike vehicles dedicated to a specific task, a wide variety of implements and equipment can be attached to and operated by a tractor including loaders, plows, snow throwers, mowers, grappling claws, post hole diggers, forks, bale spears, trenchers, hay balers, cultivators, spreaders and graters, to name a few. In order to efficiently use this wide variety of implements and equipment with a single tractor, however, such implements and equipment must be capable of quick attachment and removal from the tractor, and safe storage when other equipment or implements are being used with the tractor. Accordingly, owners and operators of tractors are constantly seeking new and improved methods and configurations for implements that allow for their quick and safe removal, attachment and storage.

The front end loader is a common implement found on most utility tractors, and its removal, attachment and storage presents specific challenges. The front end loader includes a bucket or scoop that is attached to the end of two lift arms that extend from the front of the tractor, and hydraulic cylinders that connect to the hydraulic system of the tractor to raise and lower the lift arms and rotate the bucket. The front end loader is primarily used to lift, load and transport all types of material including dirt, rocks, feed, sand, gravel, wood and snow. The bucket may also typically be detached from the lift arms so that other implements, such as grappling claws, forks or bale spears, may be attached in place of the bucket and operated by the tractor. Alternatively, secondary implements such as chains, rope, or detachable teeth may be secured to bucket.

Although useful in many applications, it is often desirable for the operator of a tractor to remove the front end loader from the tractor. When operating an implement or equipment attached to the rear of the tractor, for example, the front end loader may reduce the maneuverability of the vehicle, add unnecessary weight to the vehicle and impair the visibility of the operator. Accordingly, an operator may frequently wish to remove the front end loader from the tractor and, later, reinstall the front end loader on the tractor. Because of the size, weight and configuration of the front end loader, this process presents significant challenges.

Unlike many types of equipment that are pulled behind the tractor, the front end loader is inherently unstable due to the long and heavy lift arms that connect at their rear end to the tractor. These arms are necessarily very heavy to provide the necessary structure and support for lifting heavy loads at the end of the front ends of the arms. The arms also include heavy duty hydraulic cylinders that also add significant weight to the arms. When removed from the tractor, the rear ends of the lift arms must be supported to prevent the front end loader from toppling over from the weight of the lift arms and cylinders, which is a significant safety issue. In addition to the safety considerations, the front end loader must be stored in a position that allows for it to be quickly reattached to the tractor.

Many configurations and methods have been developed for removing a front end loader from a tractor and storing the front end loader for later reattachment. In early removable front end loader models, a heavy duty bracket was provided at the rear of the of the lift arms that was used for both attaching the front end loader to the tractor and, upon removal, supporting the rear end of the lift arms when the front end loader was stored. These configurations added significant weight to the front end loader, were complicated to operate and typically required that the bracket be bolted to the tractor when in operation and unbolted when the front end loader was removed. Although useful for earlier tractor models, earlier front end loader configurations were difficult and complicated to remove and reattach to the tractor.

Modern tractor and front end loader configurations allow for much quicker attachment and removal of the front end loader, but the front end loader must still be supported during attachment, removal and storage. In modern configurations, the front end loader is typically installed on a heavy duty bracket assembly bolted to and extending up both sides of the tractor. The rear end of the lift arms are attached to the bracket assembly, typically by mating a tower at the rear end of the lift arms with the bracket assembly and placing heavy duty pins through the towers and brackets on each side of the tractor. To support the front end loader during attachment, removal and storage, prior art front end loader configurations have often utilized a stand that lowers from the lift arms of the front end loader.

Various configurations for stands that lower from the lift arms have been utilized. Stands have been utilized that attach to and lower from the rear of the lift arms, but, when the front loader is operated, attach to and provide support for the lift arms. A simple and common stand used on modern front end loaders is secured to the support between the lift arms when the front end loader is in operation. When the front end loader is removed and stored, the stand is lowered from its storage position and pinned or bolted in place to extend below the lift arms. In this position, the stand supports the lift arms and prevents them from toppling over when stored. When the front end loader is reattached to the tractor, the stand must by raised and secured back in its storage position.

Although common, front end loader stands suffer from many disadvantages. First, all stands add unnecessary weight to the front end loader, thereby decreasing the load that can be lifted and transported by the loader. Second, a stand may become detached from the front end loader during operation and unfold from its storage position, which can result in damage to the stand, front end loader or tractor, or worse, injury to the operator. Third, if the operator forgets to return the stand to its storage position after the front end loader is attached to the tractor, the stand and the tractor can be easily damaged when the front end loader is raised, a problem that is not uncommon when a front end loader is frequently removed and reattached to a tractor. Fourth, most stands must be manually deployed and stored, which requires the operator to dismount from the tractor to deploy the stand, and typically requires pins or other attachment devices that can be lost. Finally, due to the heavy weight of the lift arms bearing down on the stand, the stand may easily sink into soft or wet ground, making it difficult to reattach the front end loader to the tractor. Thus, although front end loader stands have been widely adopted, owners and operators have sought improved configurations and methods to provide for the removal, reattachment and storage of front end loaders that eliminate the need for a stand to support the front end loader.

Configurations that have eliminated the need for a front end loader stand are disclosed in U.S. Pat. Nos. 7,172,384 and 5,895,199. These configurations utilize the bucket of the front end loader as a base for storing the lift arms when the front end loader is removed from the tractor. As disclosed in these patents, the bucket is hyper-extended forward so that it is fully beneath the lift arms and the open portion of the bucket is face down on the ground. In this position, the center of gravity of the lift arms is above the bucket so that the lift arms may be removed from the tractor without the assembly toppling over and the need for a stand is eliminated. This configuration, however, requires a specialized attachment and linkage system for the bucket to attach to the lift arms, as well as hydraulic cylinders capable of rotating the bucket farther forward than in conventional front end loaders. This specialized attachment and hydraulic system can significantly increase the cost of the front end loader, and also limit the number and types of other implements that can be utilized with the lift arms.

Accordingly, an object of the present invention is to provide a front end loader configuration and method for attachment, removal and storage that allows the front end loader to be quickly and simply removed from a utility tractor and safely stored in a position that allows for it to be quickly and simply reattached to the tractor.

A further object of the present invention is to provide a front end loader configuration and method for attachment, removal and storage that does not require the use of tools to attach and remove the front end loader from the tractor, or pins or other attachment devices that can be lost.

Yet another object of the present invention is to provide a front end loader configuration and method for attachment, removal and storage that does not add weight to the front end loader.

Another object of the present invention is to provide a front end loader configuration and method for attachment, removal and storage that utilizes existing front end loader features for a secondary use.

An additional object of the present invention is to provide a front end loader configuration and method for attachment, removal and storage that does not add components to the front end loader that can be damaged, or that could damage the tractor or injure an operator.

A still further object of the present invention is to provide a front end loader configuration and method for attachment, removal and storage that does not require the operator to dismount from the tractor when attaching and/or removing the front end loader.

Still another object of the present invention is to provide a front end loader configuration and method for attachment, removal and storage that will not allow the front end loader to sink into soft or wet ground so that it can be easily and quickly reattached to a tractor.

A further object of the present invention is to provide a front end loader configuration and method for attachment, removal and storage that can be easily adapted to conventional front end loader configurations.

Another object of the present invention is to provide a front end loader configuration and method for attachment, removal and storage that allows for the front end loader lift arms to be stored on a static object or fixed emplacement without complicated or expensive attachment mechanisms.

An additional object of the present invention is that it be adaptable for all types of front end loaders, including self-leveling front end loaders, and that it be adaptable for past, present and future models of front end loaders.

Finally, an object of the present invention is to provide a front end loader configuration and method for attachment, removal and storage that is economical to manufacture and simple in operation and deployment.

SUMMARY OF THE INVENTION

The preferred embodiment of the present invention provides a configuration for a front end loader, and a method for detaching and storing the front end loader, that allows for the lift arms of the front end loader to be safely and securely stored in a cantilevered position on an implement removed from the lift arms.

The front end loader and method of the present invention includes a bucket or other implement that is attached to lift arms at operational connections on the rear of the bucket when the front end loader is in use. In this operational position, the lift arms extend from the rear of the bucket. The lift arms may be removed from the rear of the bucket and secured to separate storage connections on the bucket or other implement. In this storage position, the lift arms extend over the front of the bucket or other implement in a cantilevered position so that the center of gravity of the lift arms is over the bucket or other implement. The lift arms may alternatively be secured to the interior scoop surface of the bucket and positioned such that the center of gravity is over the bucket or other implement. In the storage position, the lift arms may be safely detached from a tractor and left in the cantilevered position for storage. Alternatively, the lift arms may be secured for storage on any heavy static object or fixed emplacement in a similar manner.

A method for storing a front end loader is also disclosed herein. The front end loader is initially attached to a utility vehicle such as a tractor at the back end of the lift arms of the front end loader, with an implement, such as a bucket, attached to the front end of the lift arms. The method of the present invention is employed by detaching the front end of the lift arms from the implement. The utility vehicle is then moved to locate the lift arms over a stationary object, preferably the implement that was just removed from the lift arms. The lift arms are positioned so that the front end of the lift arms extends over a first side of the stationary object and the back end of the lift arms extends over a second side of the stationary object. Alternatively, the front end of the lift arms are connected to both an interior first side and a second side of the stationary object while the back end extends outward from the stationary object. The stationary object has one or more connectors located on its first side.

The lift arms are then lowered to interconnect the front end of the lift arms with the connectors on the first side of the stationary object. The lift arms are then lowered further to place the lift arms in contact with the first side of the stationary object. The back end of the lift arms is then detached from the utility vehicle and the vehicle is moved to leave the lift arms interconnected with the stationary object in a stable position for storage.

The present invention offers many advantages. Most notably, the front end loader may be quickly and simply removed from a utility tractor and safely stored in a position that allows for it to be quickly and simply reattached to the tractor. The configuration and method requires no tools or pins because the lift arms may be secured to the bucket or stationary object with simple hooks and pins. The weight of the lift arms secures the lift arms to the bucket without the need for additional pins or attachment mechanisms. The weight of the bucket also keeps the lift arms in a secure cantilevered position that will not tip over, beyond applicable industry standards, even with significant weight being placed at the free ends of the lift arms. This keeps the lift arms in the same position as when they were removed from the tractor, making it simple to reattach the lift arms to the tractor.

The front end loader and method of the present invention also adds no weight to the front end loader and does not require specialized linkages or hydraulic cylinders. The present invention may be easily adapted to conventional front end loaders and buckets by welding simple attachment mechanisms, such as hooks and pins, to existing front end loader lift arms, buckets and other implements. For example, the chain hooks on the upper edge of a bucket may be repurposed to interconnect and secure the vertical pins of lifting arm coupler mechanisms. The present invention is also adaptable for all types of front end loaders, including self-leveling front end loaders, all past, present and future models of front end loaders. In addition, the present invention eliminates any use of a stand to support the loader, and the potential for damage and other problems associated with the use of a stand.

When used with a quick attach mechanism for removing an implement from the lift arms, such as the quick attach mechanisms disclosed in U.S. Pat. No. 3,512,665 issued to Westendorf and U.S. Pat. No. 4,085,856 issued to Westendorf, an operator can remove and store the front end loader without dismounting from the tractor, and without the aid of an additional operator or assistant. This is a significant benefit, and allows a lone operator to easily and quickly remove, store and reattach a front end loader, increasing the great versatility of a utility tractor through its use of other implements and equipment.

These and other advantages will become apparent as this specification is read in conjunction with the accompanying drawings and appended claims.

BRIEF DESCRIPTION OF THE DRAWINGS

FIG. 15 shows a perspective view of two lift arms secured to a bucket in a storage orientation by J-hooks fasteners interlocking with a storage bar.

FIG. 16 shows a close-up perspective view of two quick-connect lift arms secured to an implement in a storage orientation by fasteners interlocking with a storage bar.

FIG. 17 shows a side perspective view of two lift arms secured to a bucket in a storage orientation by fasteners interlocking with bucket teeth.

FIG. 18 shows a top view of lift arms secured to a bucket in a storage orientation by J-hooks interlocking with bucket teeth.

FIG. 19 shows a top perspective view of two quick-connect lift arms secured to a bucket in a storage orientation by fasteners interlocking with bucket teeth.

FIG. 20 shows a close-up view of two quick-connect lift arms secured to a bucket in a storage orientation by J-hook fasteners interlocking with bucket teeth.

FIG. 23 shows a perspective view of two quick-connect lift arms with a stabilizer bar secured to a bucket in a face-down storage orientation by bucket hooks interlocking with the stabilizer bar.

FIG. 24 shows a close-up view of two quick-connect lift arms with a stabilizer bar secured to a bucket in a face-down storage orientation by bucket hooks interlocking with the stabilizer bar.

FIG. 25 shows a close-up view of lift arms secured to the middle of an implement with J-hooks interlocking with a T-bar.

FIG. 26 shows a bottom view of two quick-connect lift arms secured to the middle of a bucket with fasteners interlocking with a T-bar.

FIG. 27 shows a top view of two quick-connect lift arms secured to the middle of a bucket with J-hook fasteners interlocking with a T-bar.

FIG. 29 shows a close-up view of two quick-connect lift arms secured to the middle of a bucket with four J-hooks interlocking with four O-rings.

FIG. 30 shows a bottom view of two lift arms secured to the middle of an attachment with four J-hooks interlocking with four O-rings.

FIG. 31 shows a top view of two lift arms secured to the middle of a bucket with four J-hooks interlocking with four O-rings.

FIG. 35 shows a side perspective view of four fasteners on lift arms secured to three storage bars on an implement bucket.

FIG. 36 shows a top perspective view of four J-hooks on lift arms secured to three storage bars on an implement bucket.

FIG. 37 shows a close-up view of four J-hooks on two lift arms secured to three storage bars on an implement bucket.

FIG. 40 shows a top view of lift arms secured to a bucket with J-hooks, O-rings, a bucket hook, a stabilizer bar, and half of a T-bar.

FIG. 41 shows a bottom view of lift arms in a storage orientation secured to a bucket with J-hooks, O-rings, a bucket hook, a stabilizer bar, and half of a T-bar.

FIG. 56 is a side perspective view of lift arms cantilevered upon brush crushing pinching fingers.

FIG. 57 is a side perspective view of lift arms cantilevered upon a hay handling implement.

FIG. 58 is a front perspective view of lift arms cantilevered upon a plow.

FIG. 59 is a top perspective view of lift arms cantilevered upon a plow.

FIG. 60 is a side perspective view of lift arms cantilevered upon a plow.

FIG. 61 shows a side perspective view of lifting arms secured to a bucket by the top pin of an auto coupler interconnecting with a hole in a bucket.

FIG. 62 shows a side view of lifting arms secured to a bucket by the top pin of an auto coupler interconnecting with a hole in a bucket.

Figure 1:
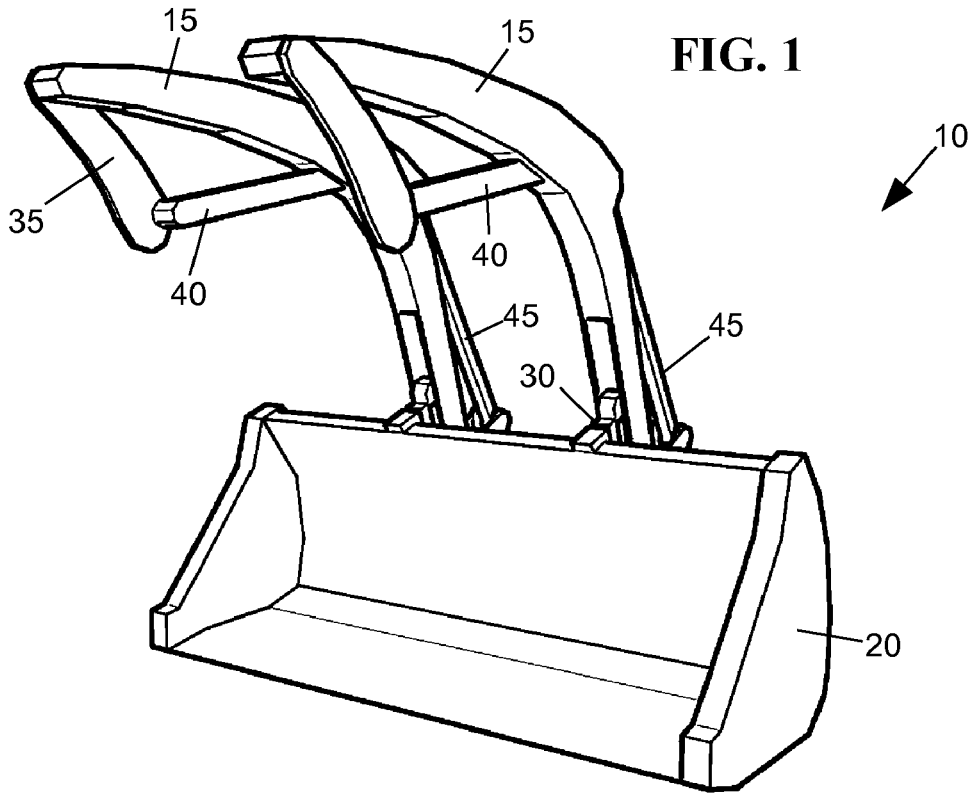
FIG. 1 shows a rear perspective view of front end lift arms stored on a bucket in a cantilevered position.
Figure 2:
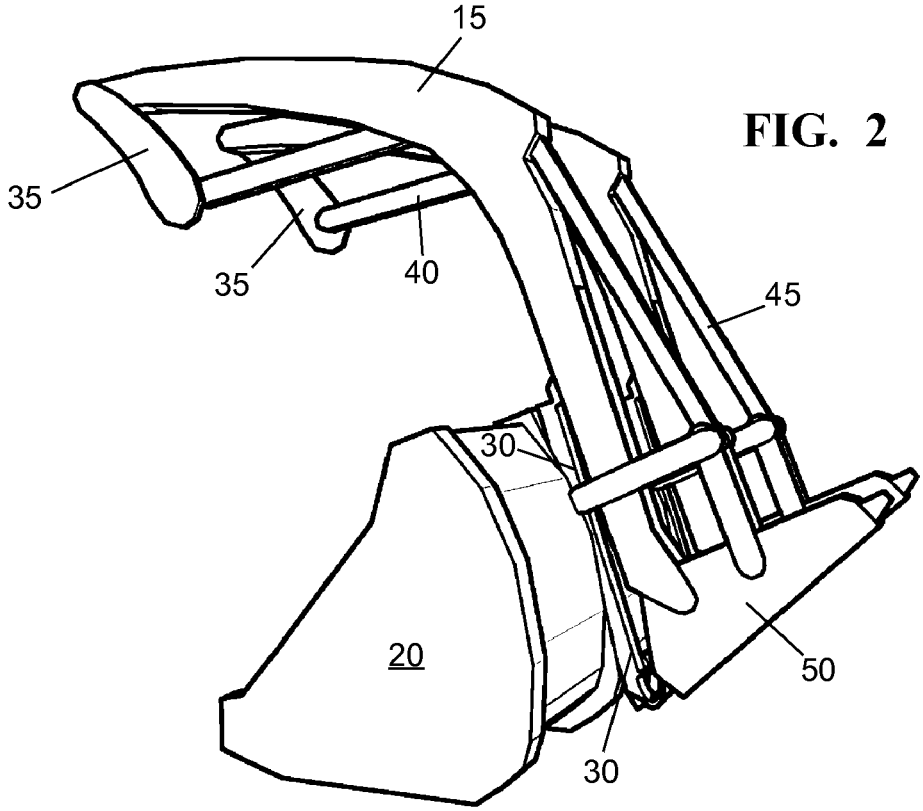
FIG. 2 shows a side perspective view of lift arms stored on a bucket in a cantilevered position.
Figure 3:
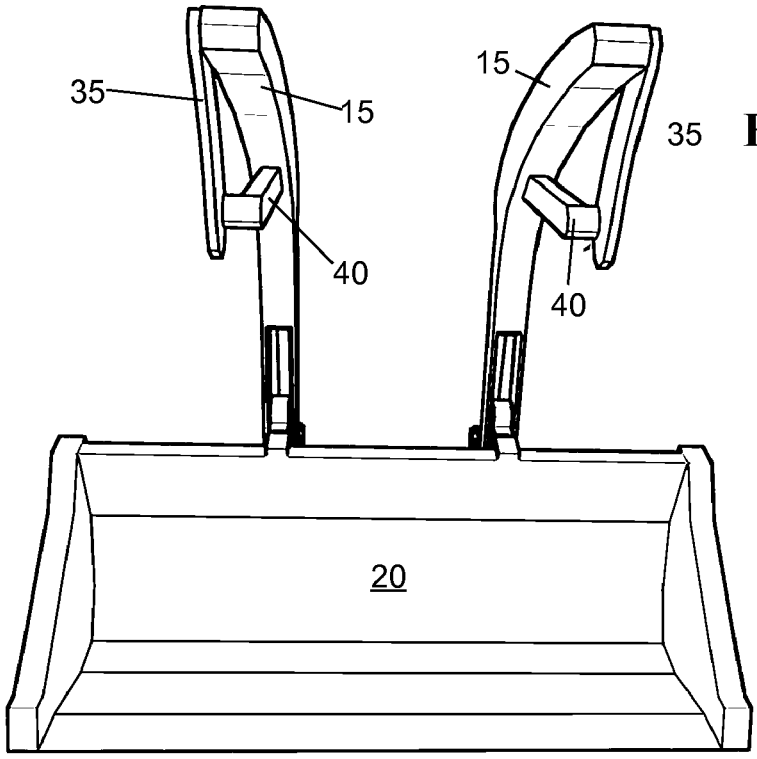
FIG. 3 shows a rear perspective view of front end loader lift arms stored on a bucket in a cantilevered position.
Figure 4:
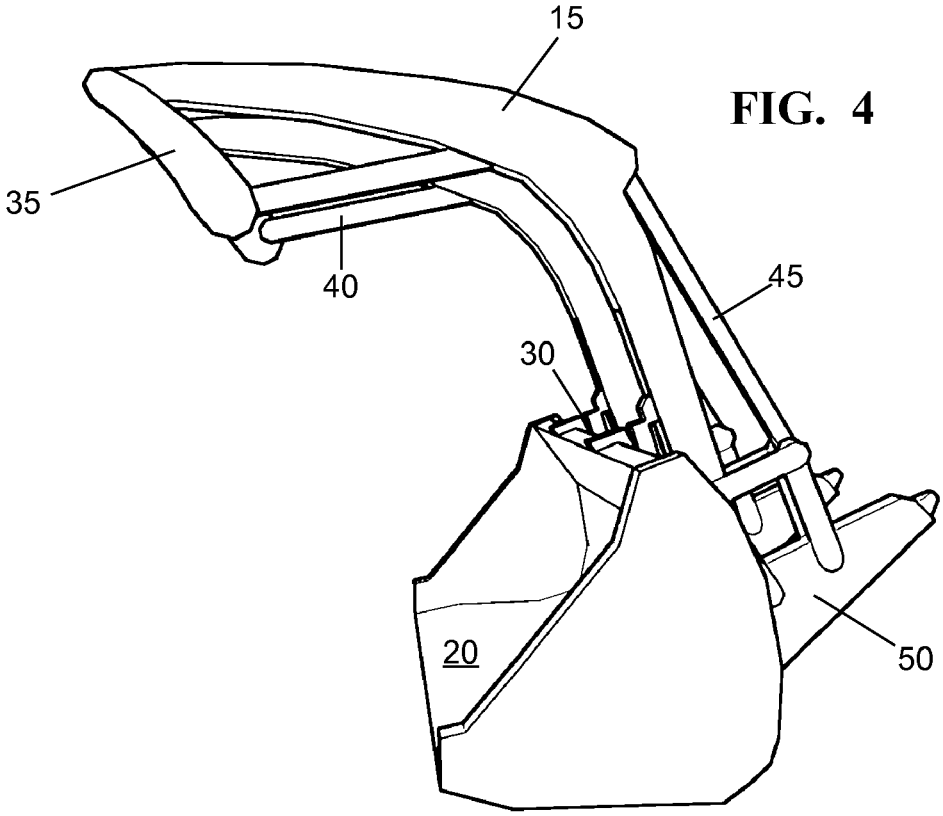
FIG. 4 shows a side perspective view of lift arms cantilevered upon a bucket.

The drawings are not necessarily to scale and certain details unnecessary for an understanding of the present invention have been omitted. The invention is not limited to the particular embodiments illustrated herein.

DETAILED DESCRIPTION

The present invention may be used with any type of implement lift arm assembly used with a vehicle for lifting and operating an implement. The preferred embodiment of the present invention, however, will be described herein for use with a front end loader. Those of skill in the art will recognize that the present invention may be used or adapted for use with any type of implement lift arm assembly. Further, although removable front end loaders are typically used with tractors, front end loaders are also used with other types of vehicles, including most notably skid steers, and the inventions disclosed herein may be used with these other types of vehicles. Those of skill in the art will recognize that the present invention is equally adaptable for use with other utility vehicles and construction machinery. Thus, the present invention is not limited to only front end loaders, nor is it limited to loaders used in connection with tractors, but is applicable to the removal and storage of any type of lift arm assembly used in connection with any type of vehicle.

FIGS. 1 through 4 show an implement and lift arm assembly 10 in a storage configuration with unsupported lift arms 15 (or booms) secured to an implement 20 resting upon the ground. The implement 20, a bucket in this example, is secured to the lift arms 15 at a lower connection point 25 and above the lower connection point, a portion of the lift arms rest upon an arm rest area 30 of the implement. The lift arms extend far above the implement and are in a cantilevered configuration such that they are only supported at the implement end of the arm. While the length of the lift arm provides leverage to keep the arms firmly pressed against the arm rest area, the weight of the implement is sufficient to prevent the assembly 10 from tipping over.

The lift arms include connection towers 35 for connecting the assembly to machinery or a vehicle. The illustrated arms also include lift cylinders 40 for raising and lowering the lift arms and implement. Implement cylinders 45 are also connected to the lift arms for moving the implement relative to the lift arms. In the illustrated example, the lift arms have quick-connect connectors 50 to facilitate changing implements when the lift arms are secured to a vehicle. By keeping the lift arms cantilevered above the implement, substantially all of the arms and cylinders are kept off the ground so that the accumulation of dirt and debris on the hydraulic cylinders and moving portions of the arms is minimized when the assembly is stored. Additionally, the connection towers are kept at an elevation similar to a corresponding bracket on a vehicle to facilitate quick and easy connection of the lift arms to the vehicle.

Figure 5:
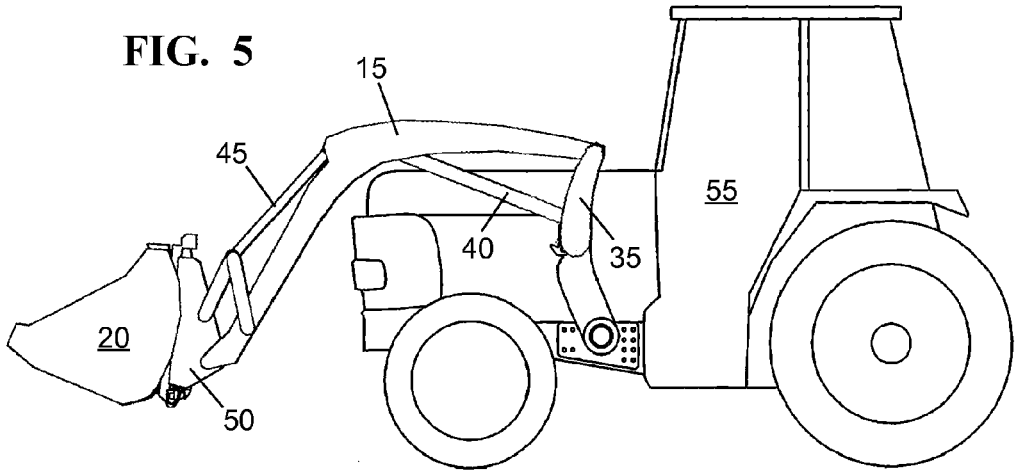
FIG. 5 shows a side view of front end loader in an operational configuration.
Figure 6:
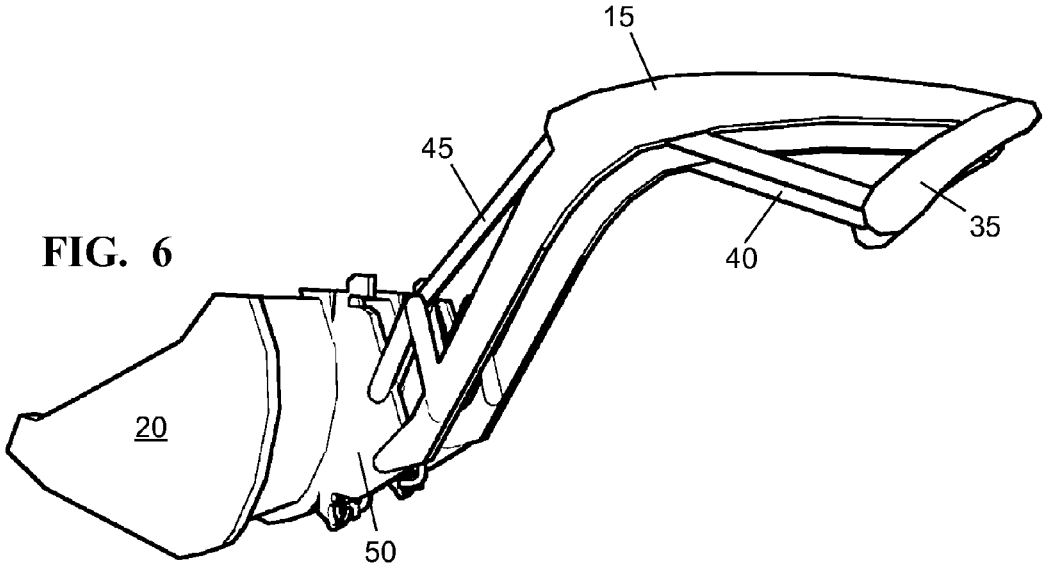
FIG. 6 shows a side perspective view of an implement and quick-connect lift arms in an operational orientation.

FIG. 5 shows the assembly of FIGS. 1-4 in active use, with an operational configuration, by a vehicle 55. In the illustrated example, the connection towers of the assembly are secured to brackets 60 on the vehicle and the quick-connect connectors 50 of the lift arm are secured to the arm rest area 30 of the implement. The implement cylinders 45 are connected such that their actuation rotates the bucket forwards and backwards while actuation of the lift cylinders 40 raises and lowers the arms and bucket. FIG. 6 shows a perspective view of the assembly of FIG. 5 without the vehicle.

Figure 7:
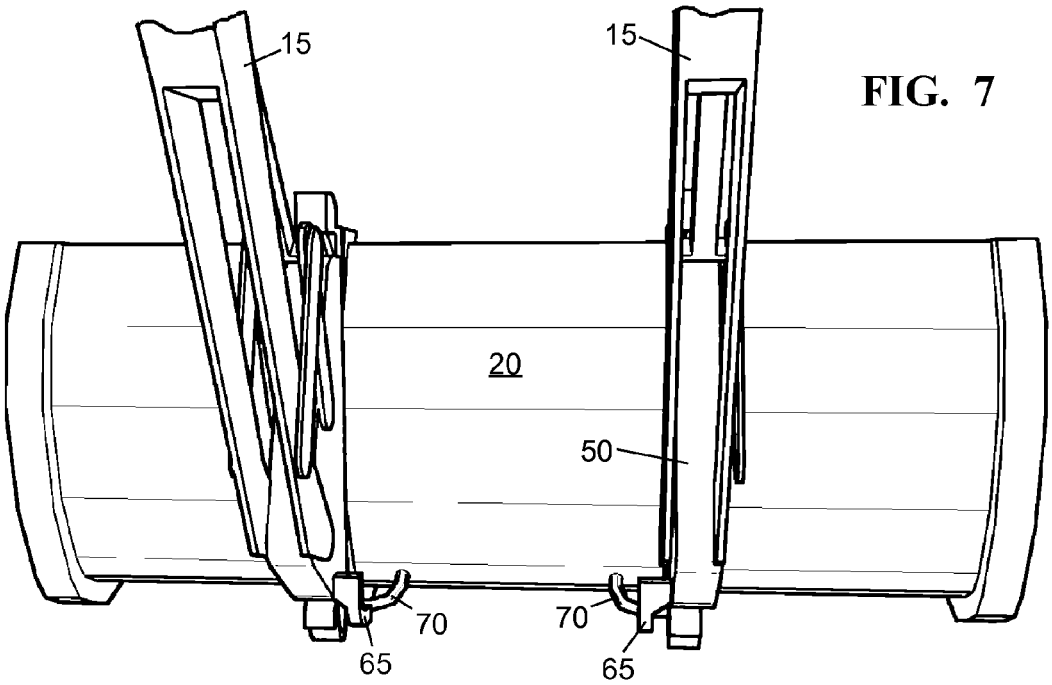
FIG. 7 shows a rear view of lift arms and an implement, each having structures for storing the lift arms in a cantilevered orientation.
Figure 8:
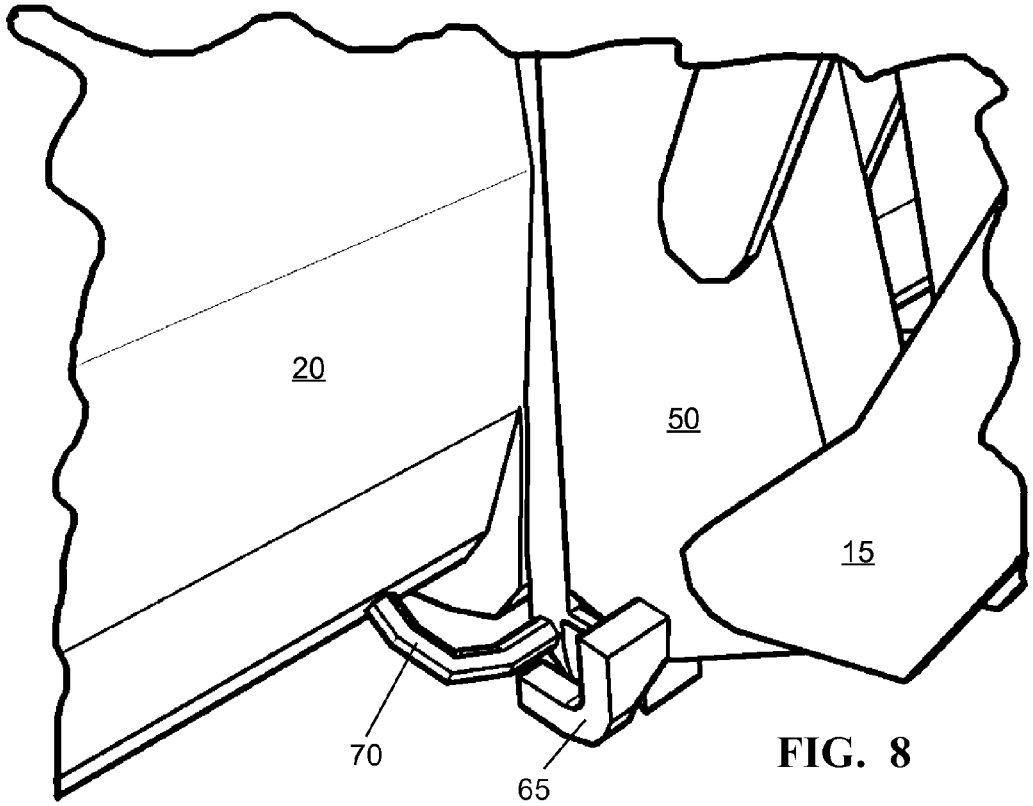
FIG. 8 shows a close up view of features on an implement and lift arm for connecting the implement to the arm in a storage orientation.

FIGS. 7 and 8 show rear perspective views of the assembly of FIGS. 5 and 6. A fastener 65 is secured to the quick-connect connector 50. On the implement 20 is located a clasp 70 structured to be secured to the fastener 65 when the lift arms 15 are stored upon the implement in a cantilevered configuration. In the example shown in FIGS. 7 and 8, the clasp is proximal to the fastener when the assembly is in an operational configuration to reduce the likelihood of either the clasp or fastener interfering with operation of the bucket implement. In other embodiments, however, the clasp and fastener may be distant from each other when the assembly is in an operational orientation.

Figure 9:
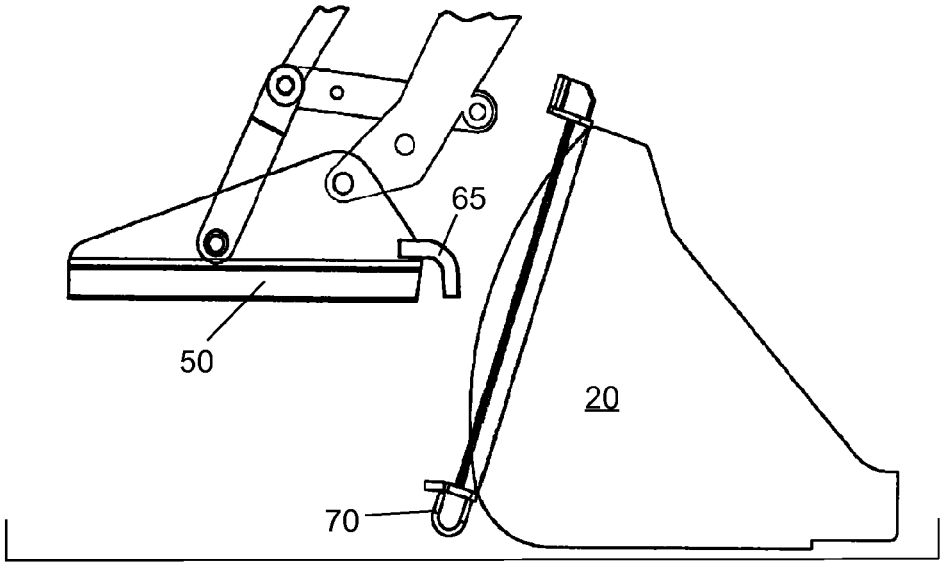
FIG. 9 shows a side schematic of a quick-connect lift arm having a storage fastener and a bucket having a storage clasp.
Figure 10:
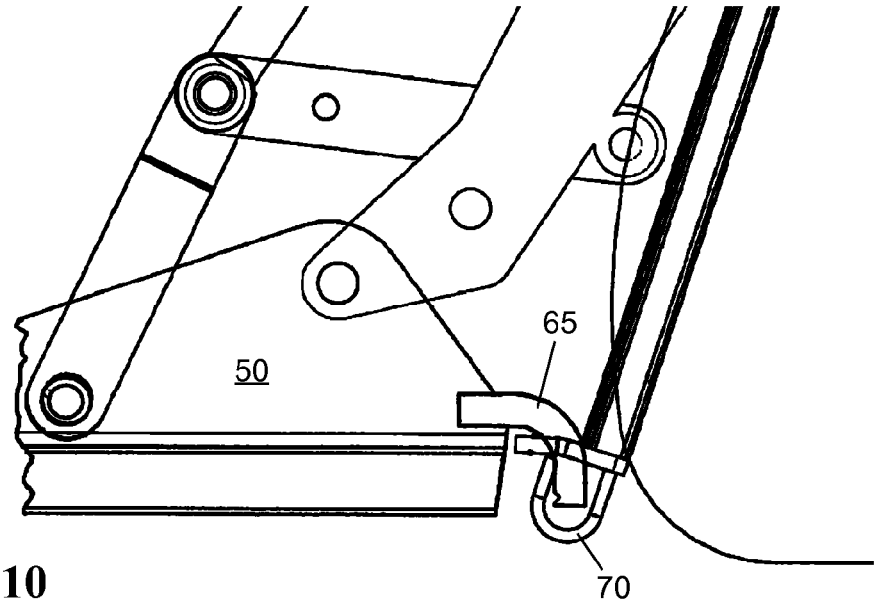
FIG. 10 shows a side view of a lift arm and bucket secured together in a storage orientation.

FIG. 9 shows a side view of an assembly with lift arms that are disconnected from an implement. The bucket implement is resting upon the ground in a storage configuration while the lift arms and quick-connect connection of the lift arm is positioned behind the back of the bucket implement. FIG. 10 shows the fastener 65 of the quick-connect connection interconnecting with the clasp 70 of the bucket implement 20.

Figure 11:
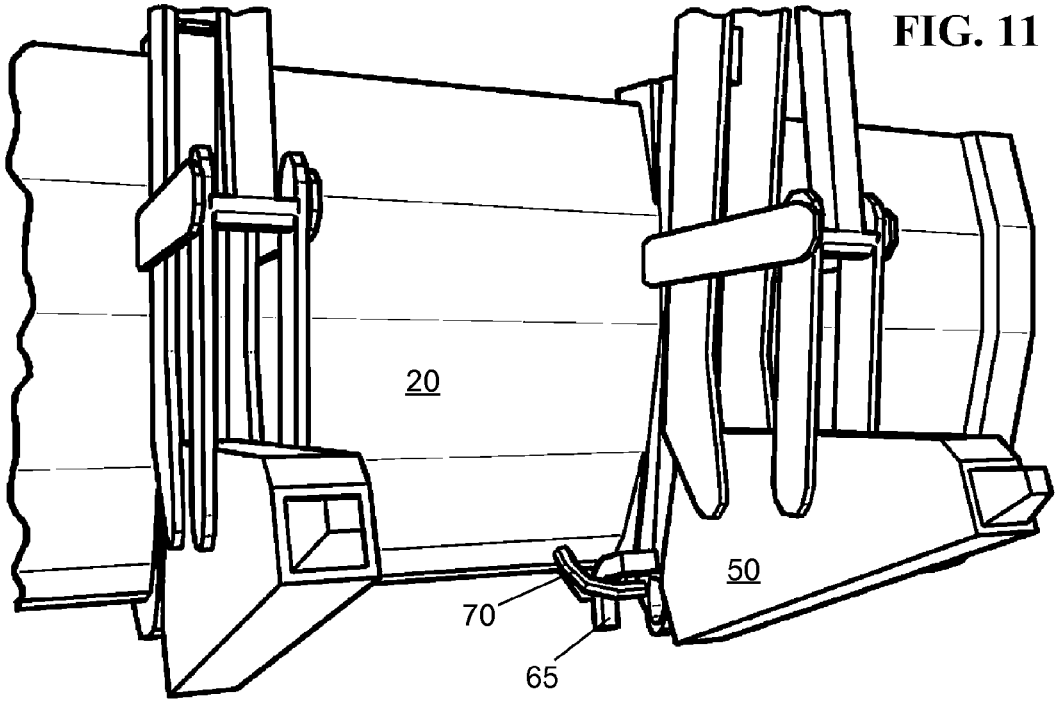
FIG. 11 shows a back perspective view of lift arms and a bucket secured together in a storage orientation.
Figure 12:
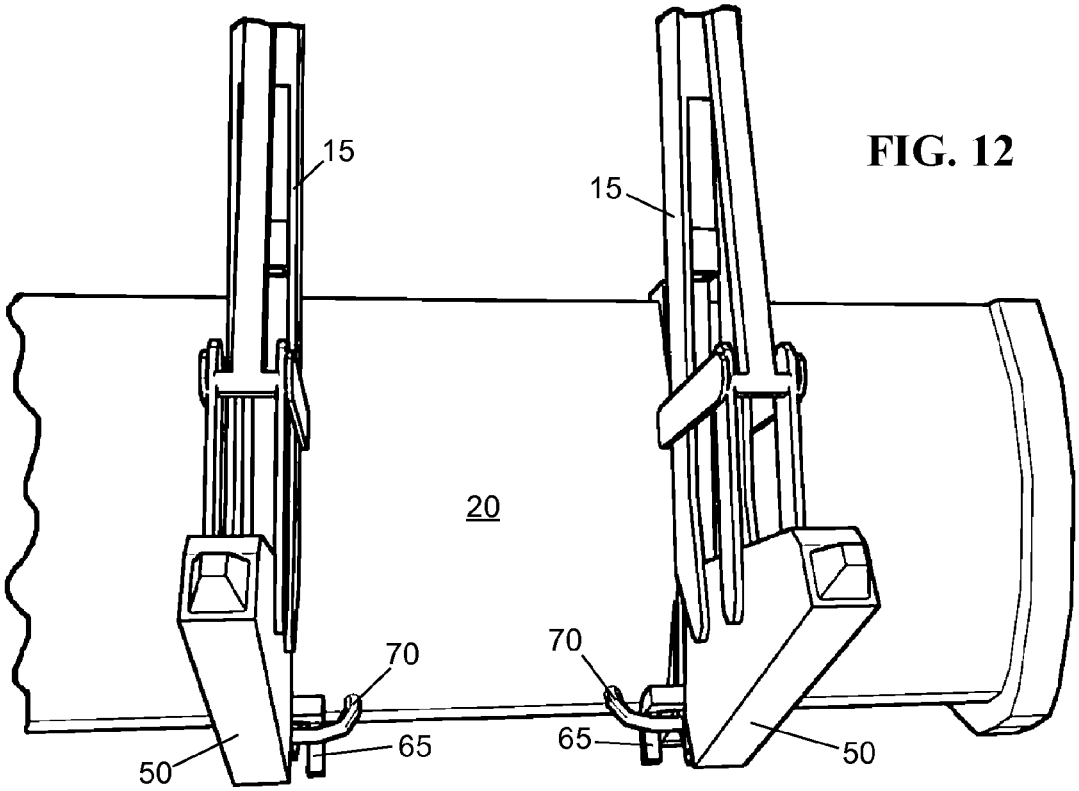
FIG. 12 shows a back view of two quick-connect lift arms secured to a bucket by two sets of interlocking J-hooks.

FIGS. 11 and 12 show close-up views of an implement lift arm assembly in a storage configuration with a fastener 65 of the loader are secured in the clasp 70 of the implement and a portion of the lift arm 15 resting upon the armrest area and 30 of the bucket arm. Most of the weight of the lift arms is positioned behind the bucket 20 such that the clasp 70 and fasteners 65 act to provide a pivot point to the lift arms and implement, while the arm rest area 30 of the implement acts to prevent the backwards rotation of the lift arms 15. Forwards rotation of the lift arms is prevented by the asymmetric distribution of the lift arm weight behind the implement. Since the weight of the lift arms primarily secures the arms in place, a vehicle or piece of construction machinery may easily disconnect the lift arms from the implement by slightly lifting the lift arms and rotating the fastener forward.

Figure 13:
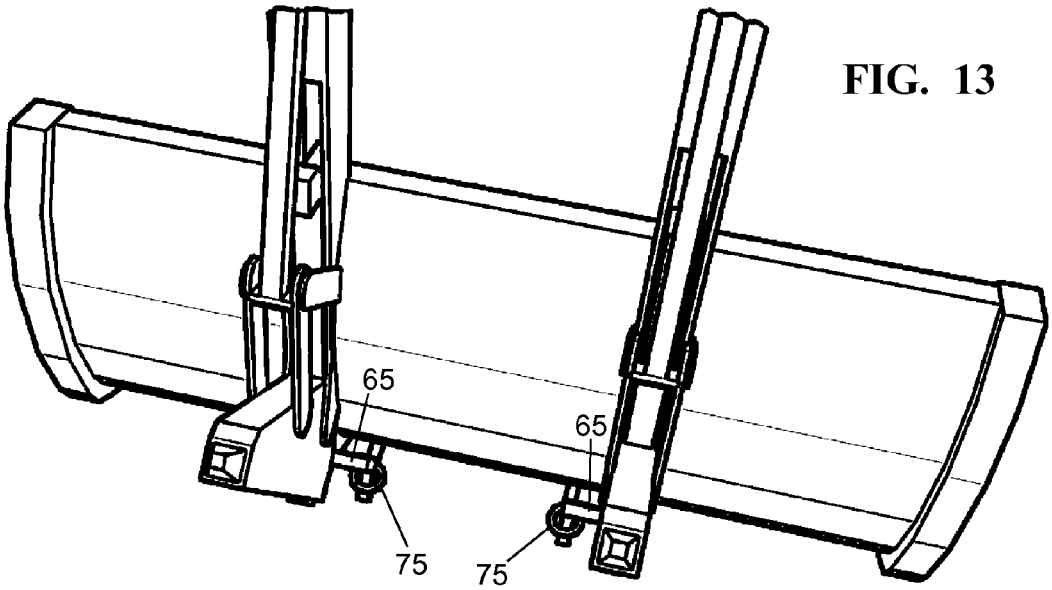
FIG. 13 shows a top rear perspective view of two lift arms secured to a bucket in a storage orientation by J-hooks fasteners interlocking with O-rings.
Figure 14:
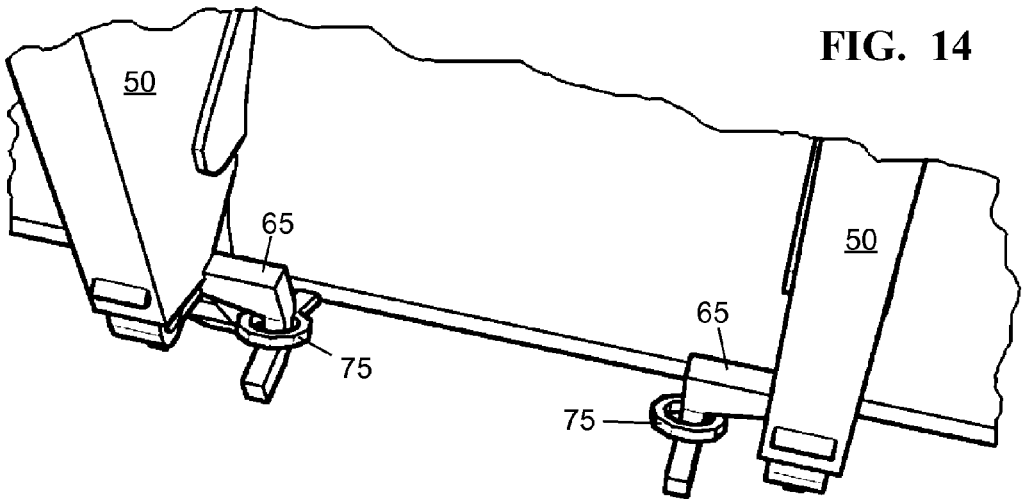
FIG. 14 shows a close up view of two quick-connect lift arms stored on a bucket with J-hooks interlocking with O-rings.
Figure 21:
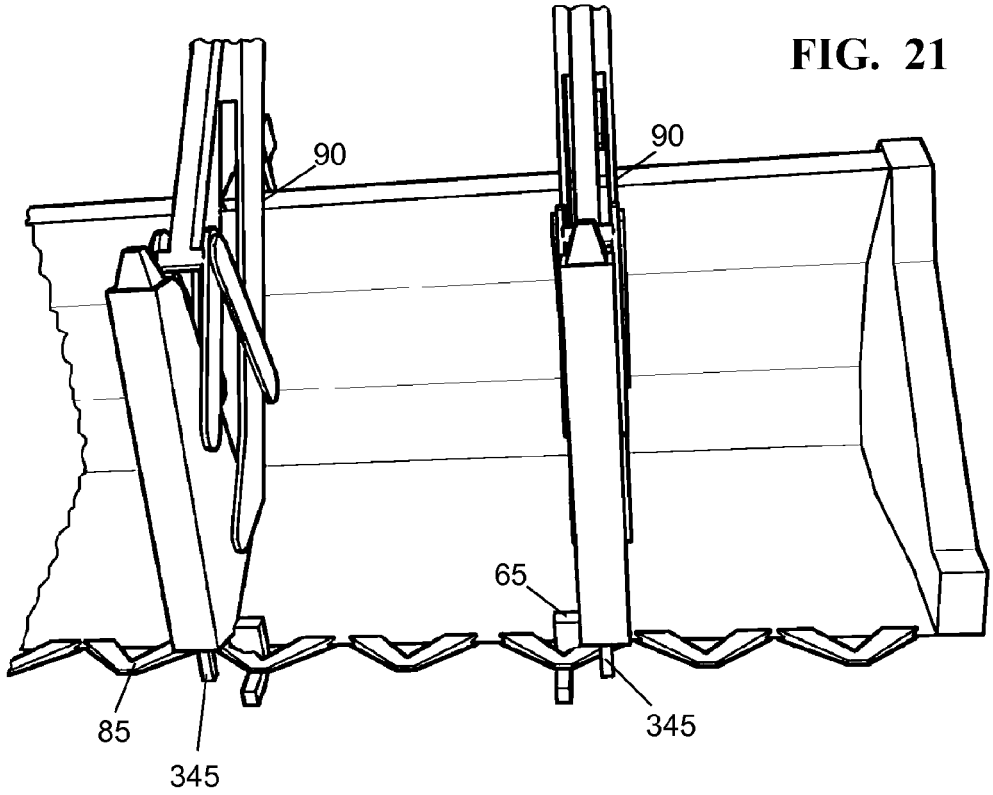
FIG. 21 shows a close-up front view of two quick-connect lift arms secured to a bucket in a storage orientation by J-hooks interlocking with bucket teeth.

FIGS. 13 and 14 show lift arms and an implement in a storage configuration. The lift arms have a fasteners 65 that interconnect with O-rings 75 extending out from the bucket. In addition to limiting the backwards rotation of the lift arms while the assembly is in a storage configuration, by snugly wrapping around the fasteners, the O-rings act to prevent lateral rotation of the lift arm that could occur if the assembly were to be stored on uneven ground with the lift arms perpendicular to the slope of the ground.

FIGS. 15 and 16 illustrate an example of an assembly having a bucket with a storage bar 80 for interconnecting with fasteners 65 on the lift arms when the assembly is in a storage configuration. The illustrated storage bar spans a substantial width of the bucket, such that the fasteners of the lift arm need not be precisely placed when the assembly is put into a storage configuration.

FIGS. 17 through 21 illustrate an example of lift arms cantilevered upon a bucket implement wherein the lift arms are interconnected with teeth 85 located about the perimeter of the open-face of the bucket and the bucket top 90 acts as an arm rest area to prevent backwards rotation of the lift arms. The teeth 85 of the bucket are constructed with openings 95 such that fasteners may be paced though the bucket teeth while the assembly is in a storage configuration. In the illustrated example, the bucket teeth include openings 95 for interconnecting with the fasteners of the lift arms, however other structures for securing the fastener to the teeth may be used and are within the scope of the present invention. For example, as shown in FIG. 19, holes 87 drilled in the bucket may be used to interconnect with fasteners.

Figure 22:
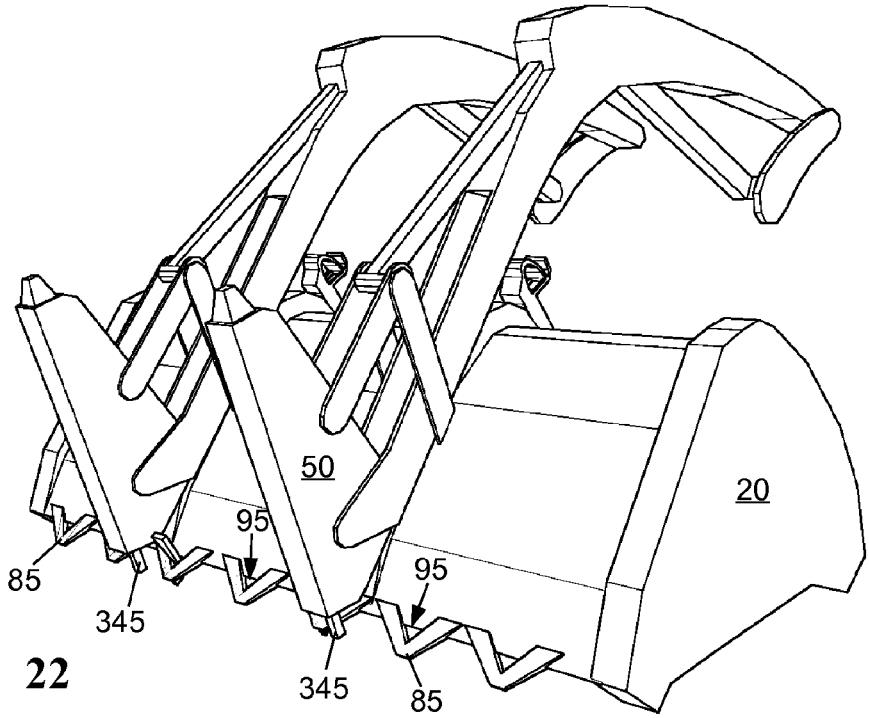
FIG. 22 shows a perspective view of lift arms secured to a bucket in a face-down storage orientation by J-hooks interlocking with bucket teeth.

FIG. 22 illustrates an example of an assembly in a storage configuration having lift arm fasteners 65 interconnected with loader teeth 85 while the open-face of the bucket is facing down. Since the teeth the located about the perimeter of the open-face, they are accessible to the fasteners even when the open face of the bucket is oriented downwards. In the illustrated example, the arm rest region of the bucket is located on the portion of the bucket used for scooping when the assembly is in an operational orientation. The teeth 85 of the bucket may be constructed such that the lift arm fasteners may be interconnected when the bucket is in any of the orientations shown in FIGS. 17 through 22.

FIGS. 23 and 24 illustrate an example of a bucket that uses integral features of a quick-connect connector to secure the lift arms to the implement when the assembly is in a storage configuration. A stabilizer bar 100 extends between a first and second quick-connect connector of two lift arms. The stabilizer bar helps to maintain both of the quick-connect connectors of the lift arms in the same orientation to facilitate connecting the lift arms to the bucket in an operational orientation. Alternatively, the stabilizer bar may be used in combination with the pinching fingers disclosed in U.S. Pat. No. 7,566,197 issued to Westendorf. When the assembly is in a storage configuration, bucket hooks 105 partially wrap around the stabilizer bar 100 to maintain the lift arms in a cantilevered storage orientation.

Figure 28:
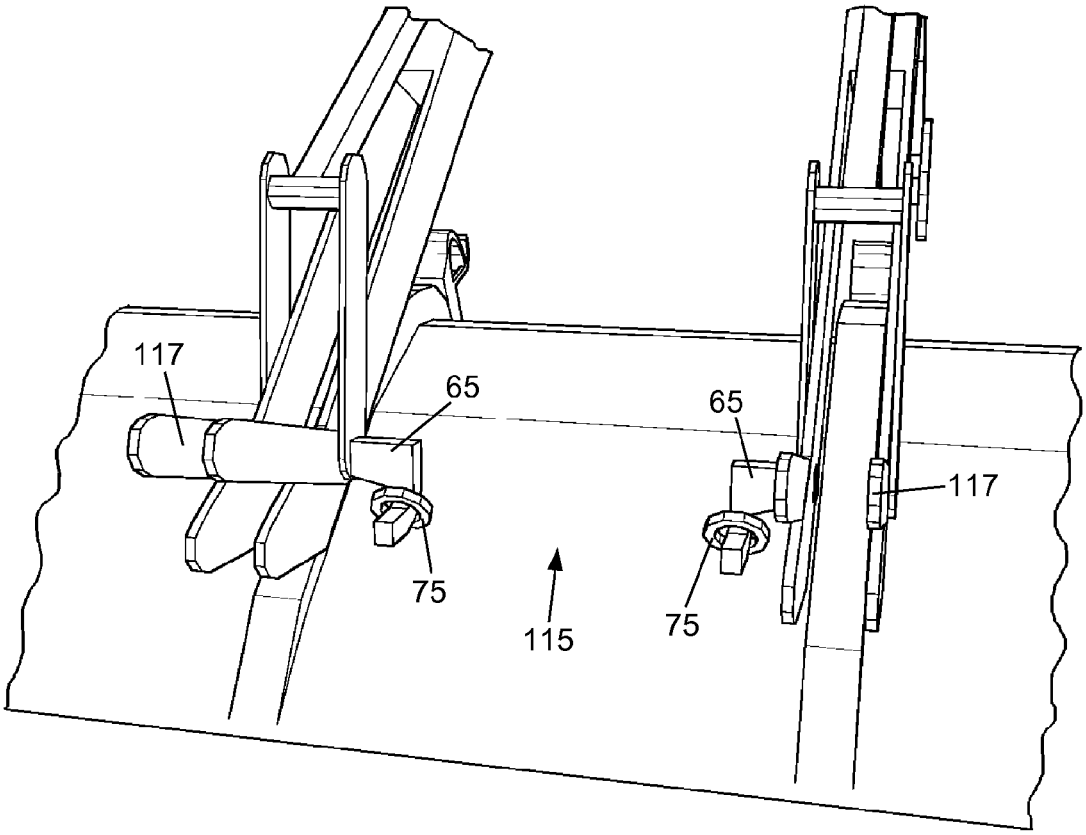
FIG. 28 shows a top view of two lift arms secured to the middle of an implement with two J-hooks interlocking with two O-rings.

FIGS. 25 through 27 shows a T-bar 110 secured to a bucket implement at the middle regions 115 of the bucket. The lift arms illustrated in FIG. 25 have conventional implement connections 117 instead of quick-connect connectors and the fasteners are directly secured to the lift arms. Securing the lift arms at a middle region of the bucket helps to further elevate the lift arms above the ground dirt and debris. Additionally, securing the lift arms to the middle regions of the bucket may facilitate placing the assembly in a storage configuration because the lift arms do not have to be wrapped as far around the bucket to reach the T-bar on the bucket. Furthermore, some lift arms may not be able to rotate the fasteners enough to place them in an orientation so that they may be interconnected with the T-bars lower down on the implement. FIGS. 26 and 27 show lift arms with quick-connect connectors having fasteners secured to T-bars on the middle regions of implement buckets. Other structures, such as the O-rings 75 shown in FIG. 28, may be utilized to secure the lift arms to the middle portions 115 of the implement when the assembly is in a storage orientation.

As shown in the FIGS. 1 through 28 the fasteners on either the quick-connect connectors or the lift arms are preferably located between the lift arms so that the fasteners are protected from brush and other miscellaneous objects that may scrape the outer portions of the lift arms. However, as illustrated in FIGS. 29 through 31, the fasteners may also be located on the less protected exterior portions 120 of the lift arms. By locating some of the fasteners, and corresponding implement structures, on the more exterior/lateral regions of the implement, the loader operator may be able to more easily confirm that the lift arms are secured to the implement in a storage configuration. Additionally, the extra fasteners and corresponding structures help to secure the cantilevered lift arms to the implement and provide additional redundancy in case one of the fasteners or corresponding structures on the implement should break. The larger separation of the fasteners also helps to increase the lateral stability of the cantilevered lift arms stored above the implement by providing a wider footprint of the lift arms upon the implement.

Figure 32:
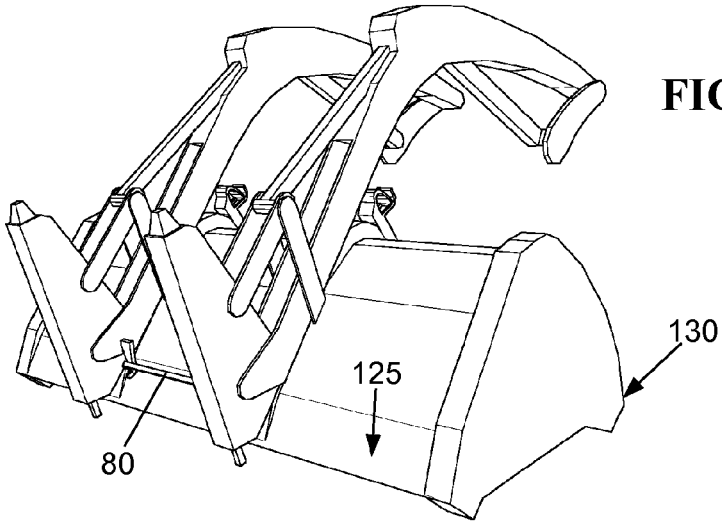
FIG. 32 shows a side perspective view of two quick-connect lift arms secured to a bucket by J-hooks on the lift arms interlocking with a storage bar on the bucket.
Figure 33:
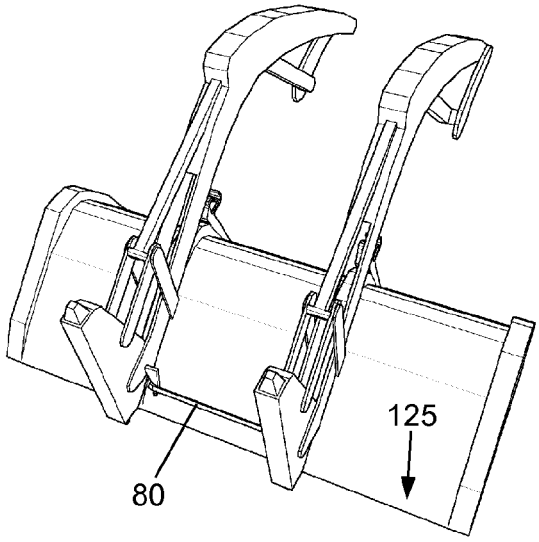
FIG. 33 shows a top perspective view of lift arms secured to a bucket with J-hooks on the lift arms interlocking with a storage bar on the bucket.
Figure 34:
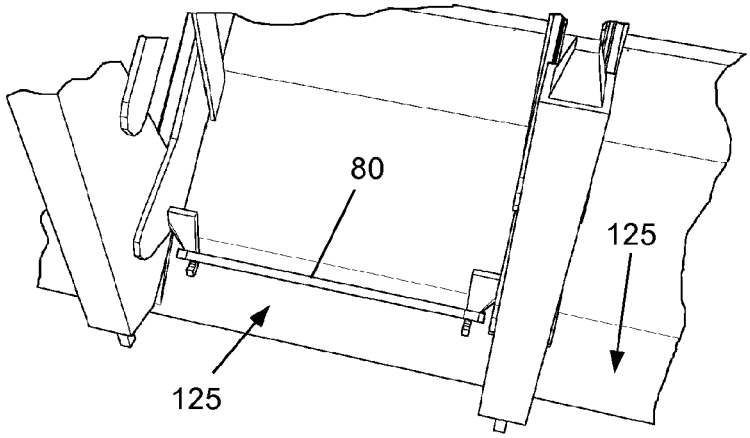
FIG. 34 shows a close-up view of two quick-connect lift arms secured to a bucket with J-hooks on the lift arms interlocking with a storage bar on the bucket.
Figure 38:
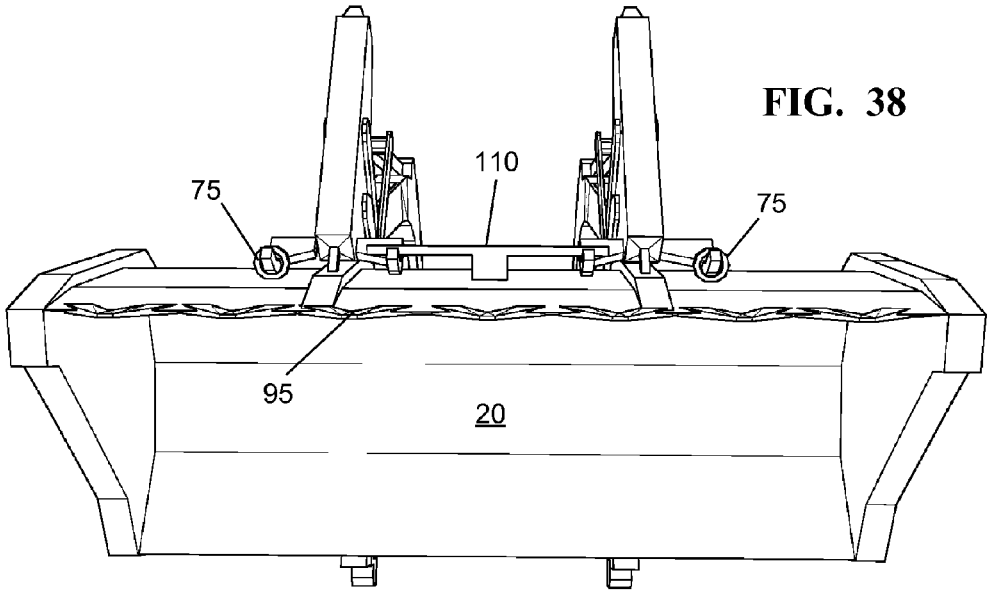
FIG. 38 shows a bottom perspective view of lift arms in a storage orientation secured to a bucket with J-hooks, O-rings, and a T-bar.

FIGS. 32 through 37 show two examples of fasteners directly secured to lift arms for interconnecting with storage bars 80 to maintain the lift arms in a cantilevered storage configuration. While the lift arms of FIGS. 32 through 37 have quick-connect connectors, the lift arms are directly secured to the fasteners. In FIGS. 32 through 34, the open face of the bucket implement is oriented downwards and a single storage bar is utilized to secure both lift arms to the bucket implement. In the illustrated example the storage bar is connected to a lower region 125 when the assembly is in an operational orientation, however the storage bar may alternatively be secured to a higher region 130 (when in an operation configuration) of the bucket. Alternatively, the bucket may have two storage bars, one at each location.

FIGS. 35 through 37 illustrate lift arms that each have two fasteners flanking the lift arms. The illustrated implement has a storage bar 80 located between two auxiliary bars 135 that acts to interconnect with the fasteners of the lift arms when the assembly is in a storage configuration.

Figure 39:
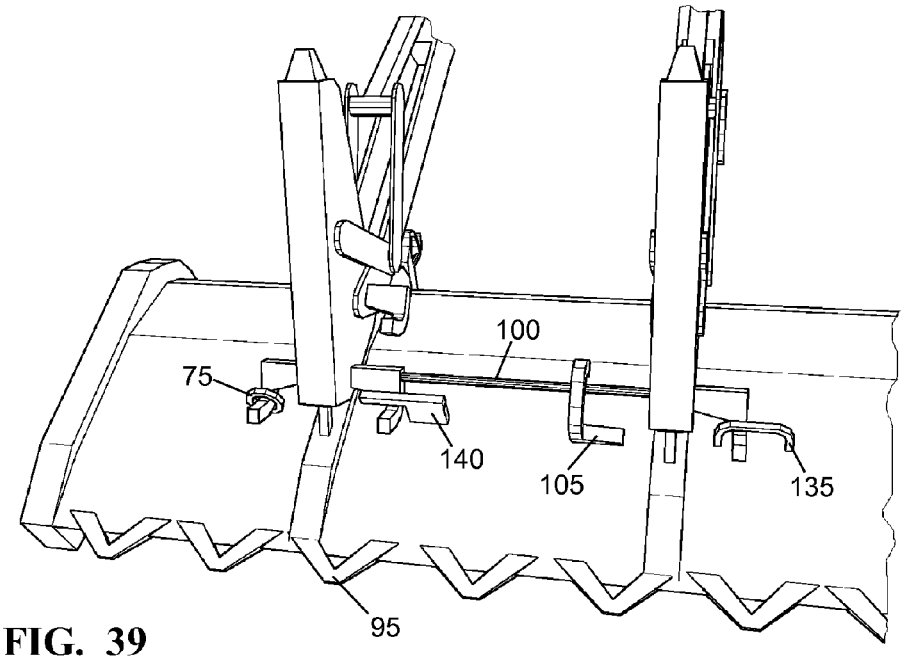
FIG. 39 shows a top perspective view of lift arms in a storage configuration that are secured to a bucket with J-hooks, O-rings, a bucket hook, a stabilizer bar, and half of a T-bar.

As illustrated in FIGS. 38 through 41 the disclosed features utilized to secure the lift arms 15 to the bucket 20 in a storage configuration are not mutually exclusive. In FIG. 39, O-rings 75 are utilized on the exterior portions of the implement, while a T-bar 100 connector is utilized on the interior portions of the implement. A more robust type of connector may be utilized on the exterior regions of the implement and lift arms, while a type of connector that is easier to visualize may be utilized on the interior portions of the connector. FIGS. 39 through 41 show lift arms 15 that are connected to a bucket implement by four distinct types of connections (an O-ring 75, a half T-bar 140, a stabilizer bar 100 & bucket hook 105, and an auxiliary bar 135). Additionally, the implement teeth 95 may be utilized to secure the lift arms to the implement.

Figure 42:
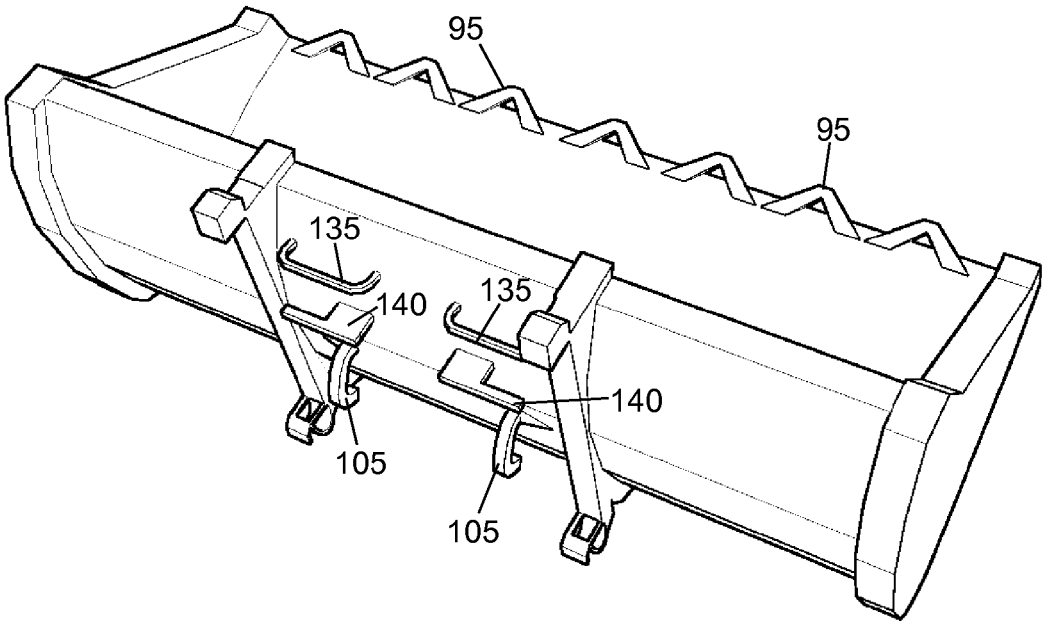
FIG. 42 shows a perspective view of a bucket with storage bars, teeth, bucket hook, and half T-bars structured to be connected to lift arms stored upon the bucket.

As seen in FIG. 42 the implement may have a plurality of different sets of connectors. Multiple connectors may allow the implement to be used as a base for multiple makes and models of cantilevered lift arms. In FIG. 42 the multiple sets of connectors are all located between the connections utilized when the implement is in an operational orientation. When in operation, the lift arms and implement surround the unused connectors on three sides to protect the connectors. Also, since the connectors are substantially surrounded, the connectors are unlikely to interfere with the operation of the implement and assembly.

Figure 43:
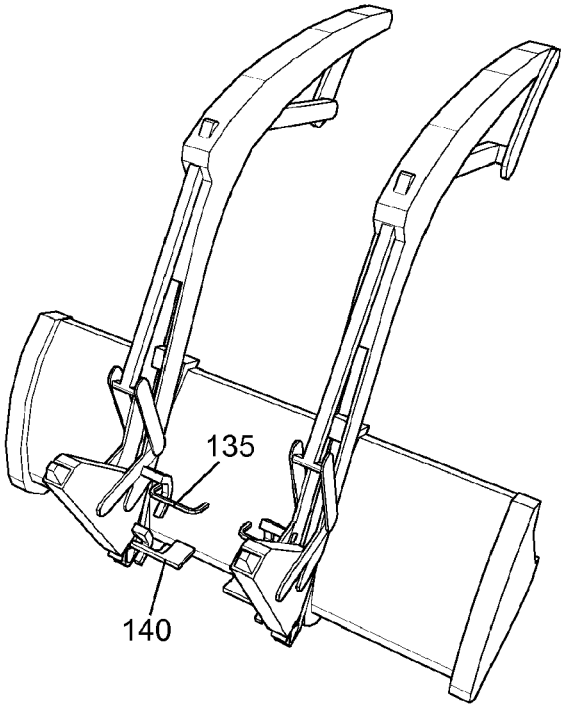
FIG. 43 shows a perspective view of hooks on both lift arms and quick connectors securing the lift arms to the bucket.
Figure 44:
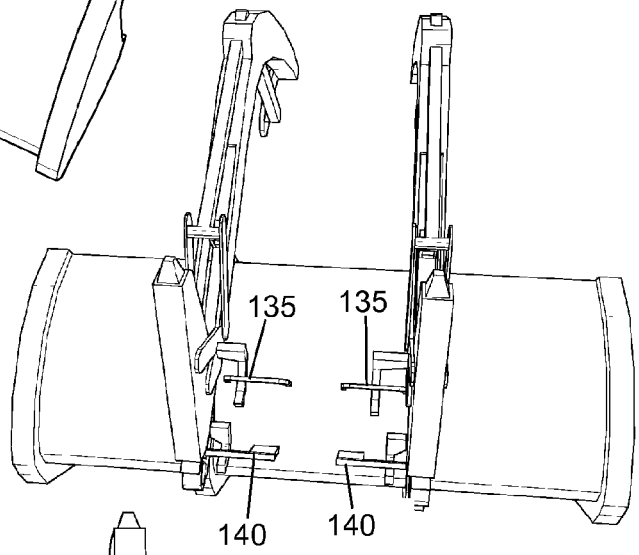
FIG. 44 shows a front view of hooks on both lift arms and quick connectors securing the lift arms to the bucket.
Figure 45:
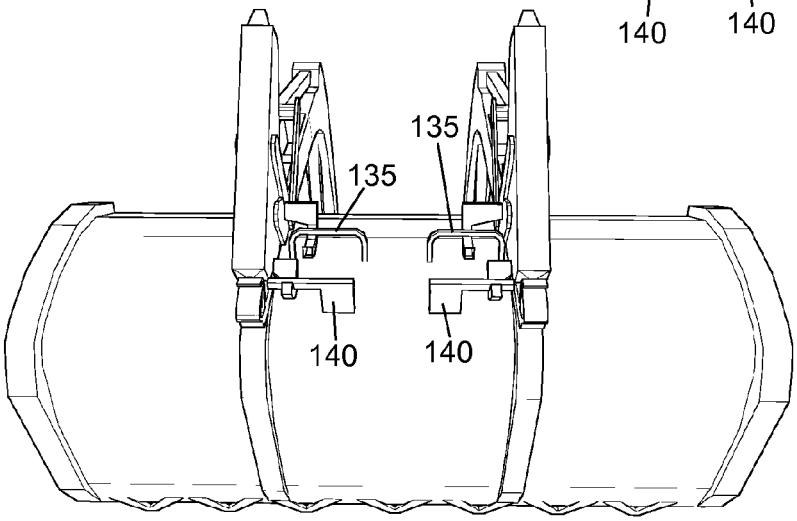
FIG. 45 shows a bottom view of hooks on both lift arms and quick connectors securing the lift arms to the bucket.

In addition to the implement having multiple connectors, the lift arms may include multiple fasteners as well. As seen in FIGS. 43 through 45 a set of fasteners is directly connected to the lift arms while a second set of fasteners is directly secured to the quick-connect connector. The use of multiple fasteners on the lift arms may help to secure the lift arms to the implement. For example, a fastener may be secured to the lift arm, and an oppositely oriented fastener may also be secured to the quick-connect connector. By rotating the quick-connect connector relative to the lift arm, the two fasteners may be used to clamp down on a connector secured to an implement.

Figure 46:
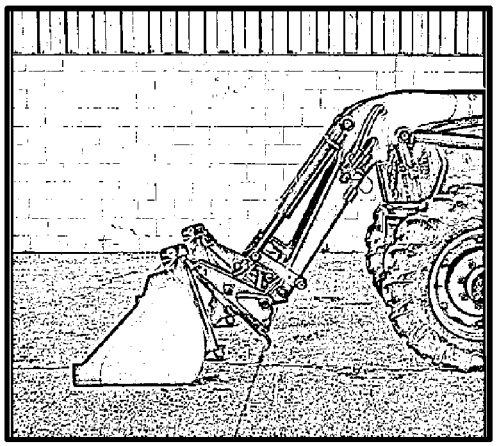
FIG. 46 shows an "uncoupling a bucket remotely" step in a method for storing lift arms upon an implement in a cantilevered orientation.
Figure 47:
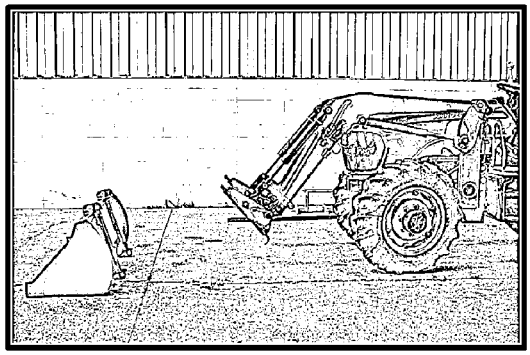
FIG. 47 shows a "backing away and driving around to the other side of a bucket" step in a method for storing cantilevered lift arms upon an implement.
Figure 48:
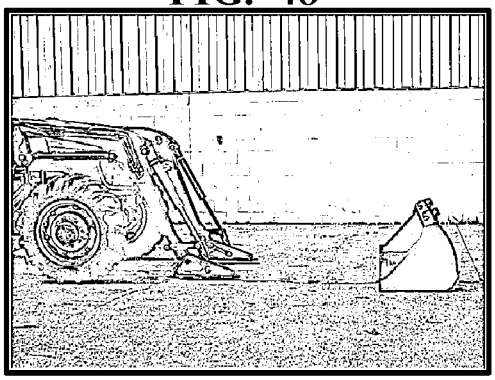
FIG. 48 shows an "approaching a bucket from the front side" step in a method for storing cantilevered lift arms upon an implement.
Figure 49:
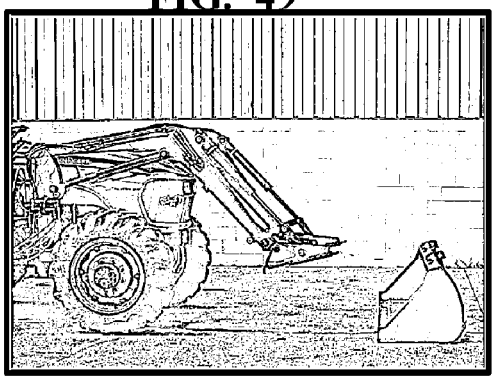
FIG. 49 shows an "align the lift arms with the receivers on the bucket" step in a method for storing cantilevered lift arms upon an implement.

FIGS. 46 through 55 illustrate a method for detaching and storing lift arms in a cantilevered configuration upon a bucket. Initially, the bucket is lowered onto the ground and disconnected from the lift arms as seen in FIG. 46. In FIG. 46 the bucket is disconnected by disengaging a portion of a quick-connector, however, other methods of disconnecting the bucket may be utilized. In FIG. 47, the vehicle is backed away from the bucket and then driven around to the other side of the bucket as seen in FIG. 48. In FIG. 49, the lift arms of the vehicle are aligned with the receivers on the bucket. In FIG. 49, the bucket clasps that secure the fasteners of the lift arms are not visible to the operator of the vehicle, however since the clasps are positioned near the receivers on the bucket, the clasps and fasteners may be aligned by simply aligning the lift arms and the receivers.

Figure 50:
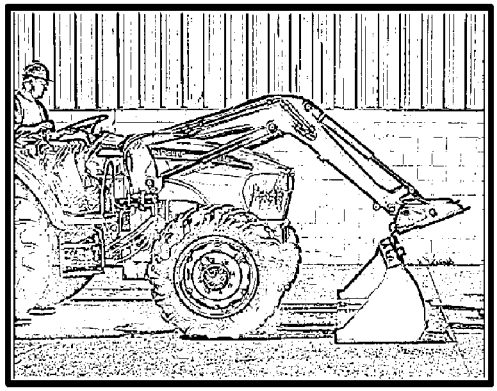
FIG. 50 shows a "raising the lift arms over the bucket" step in a method for storing cantilevered lift arms upon an implement.
Figure 51:
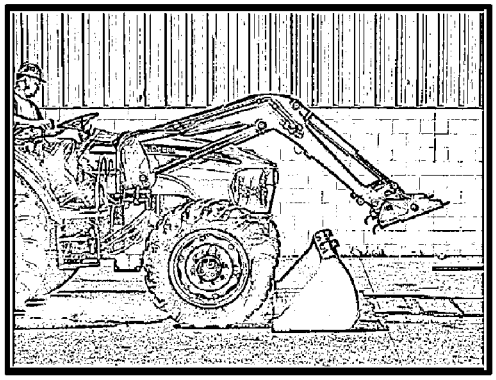
FIG. 51 shows a "dropping the lift arms over the back side of a bucket" step in a method for storing cantilevered lift arms upon an implement.
Figure 52:
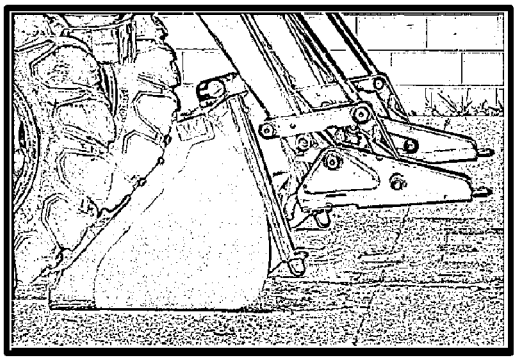
FIG. 52 shows a "lower the lift arms" step in a method for storing cantilevered lift arms upon an implement.

In FIG. 50, the vehicle has been moved towards the bucket and the lift arms are lifted over the bucket. In FIG. 51, the vehicle is moved even closer to the bucket so that the lift arms may be dropped down on the back side of the bucket as seen in FIG. 52.

Figure 53:
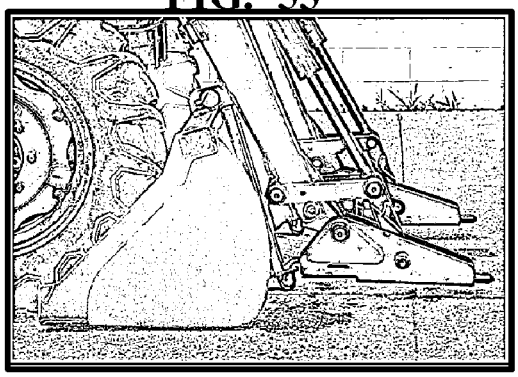
FIG. 53 shows a "drop and hook the adapter" step in a method for storing cantilevered lift arms upon an implement.
Figure 54:
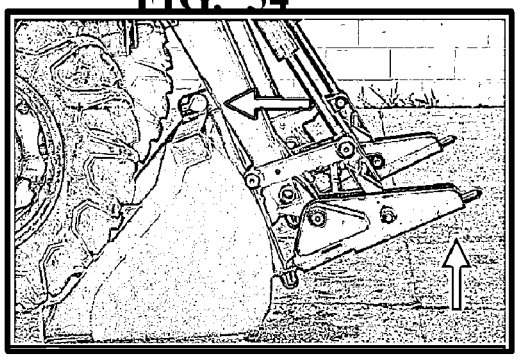
FIG. 54 shows an "engage the bucket cylinders to rest the lift arms against the back of the bucket" step in a method for storing cantilevered lift arms upon an implement.

In FIG. 53, the fasteners of the lift arms are interconnected with the clasps of the bucket. The lift arms pivot about the interconnection when the lift arms are rotated backwards towards the lift arm rest region (the receivers in the example) of the bucket as seen in FIG. 54. In FIG. 54, the weight of the lift arms is supported by the arm rest region of the bucket, while the interconnection of the fasteners prevents the lift arms from rotating about the top of the bucket.

Figure 55:
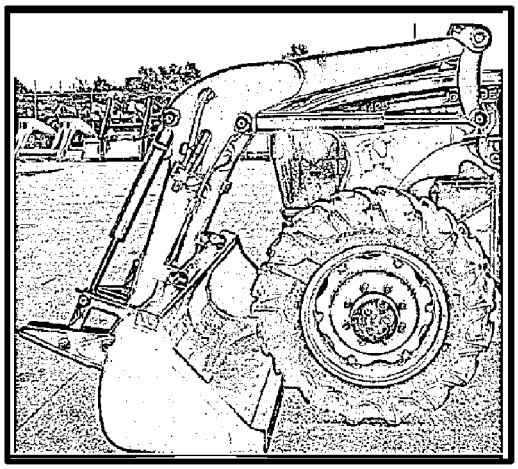
FIG. 55 shows a "loader safely parked in a cantilevered orientation" step in a method for storing cantilevered lift arms upon an implement.

The vehicle is then disconnected form the lift arms such that the arms a positioned in a cantilevered configuration above the bucket. Finally, hydraulic lines extending between the lift arms and the vehicle may be disconnected. FIG. 55 shows the vehicle backing away from the stored assembly having a bucket base and cantilevered lift arms.

The assembly may be returned to the operational configuration by performing the steps of FIGS. 46-55 in reverse. Additionally, based on how the bucket interconnects with the lift arms in the storage configuration, some of the illustrated steps may not be needed. For example, if the fastener on the lift arms interconnects with the teeth of the bucket (as shown in FIG. 17), the steps shown in FIGS. 47-49 may be omitted because the orientation of the lift arms with respect to the bucket does not change. Alternatively, additional steps may be added to the illustrated example. For example, if the open face of the bucket is down when in a storage configuration (such as in FIG. 32), a step of flipping the bucket over with the quick-connectors may be added between the steps shown in FIGS. 46 and 47.

Although lift arms stored in a cantilevered configuration upon an implement bucket is an exemplary embodiment of the invention, other implements may also be utilized. As seen in FIG. 56, pinching fingers 300 may be used as a base for the lift arms. Alternatively, as seen in FIG. 47, the lift arms may be balanced upon a hay handling implement. A plow 310 with a connection bar 315 may serve as a base for lift arms as seen in FIGS. 58-60. In addition to other implements, any sufficiently heavy stationary object, such as a large block of concrete, or even a fixed emplacement, may be constructed with features that interconnect with the fasteners on the lift arms such that the arm assembly may be stored in a cantilevered configuration upon the object.

Figure 63:
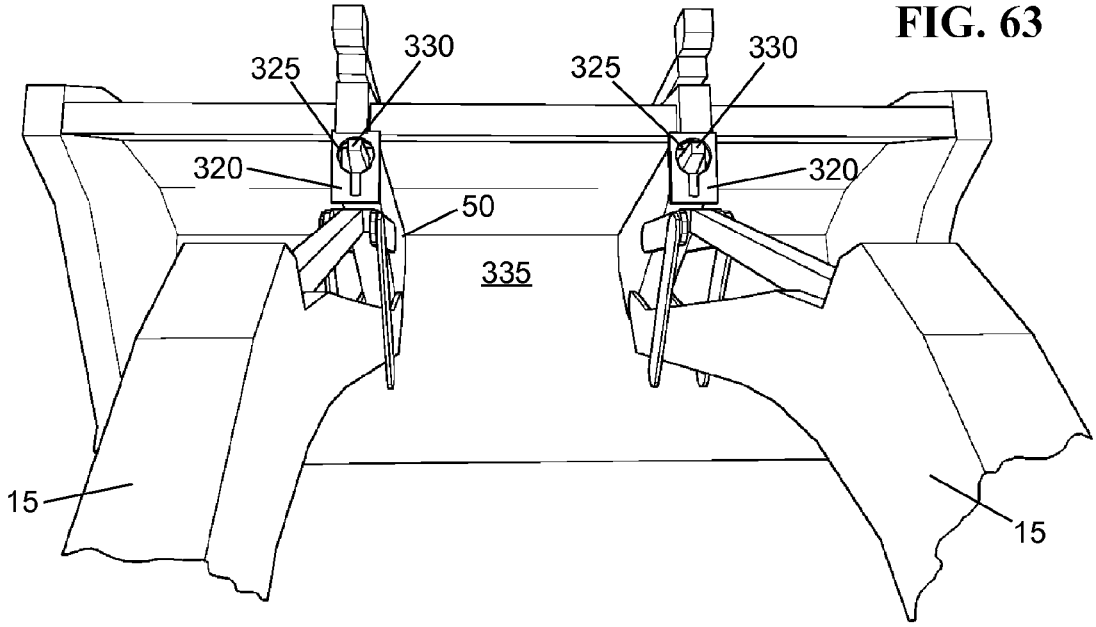
FIG. 63 shows a rear perspective view of lifting arms secured to a bucket by the top pins of an auto coupler interconnecting with chain hooks of a bucket.
Figure 64:
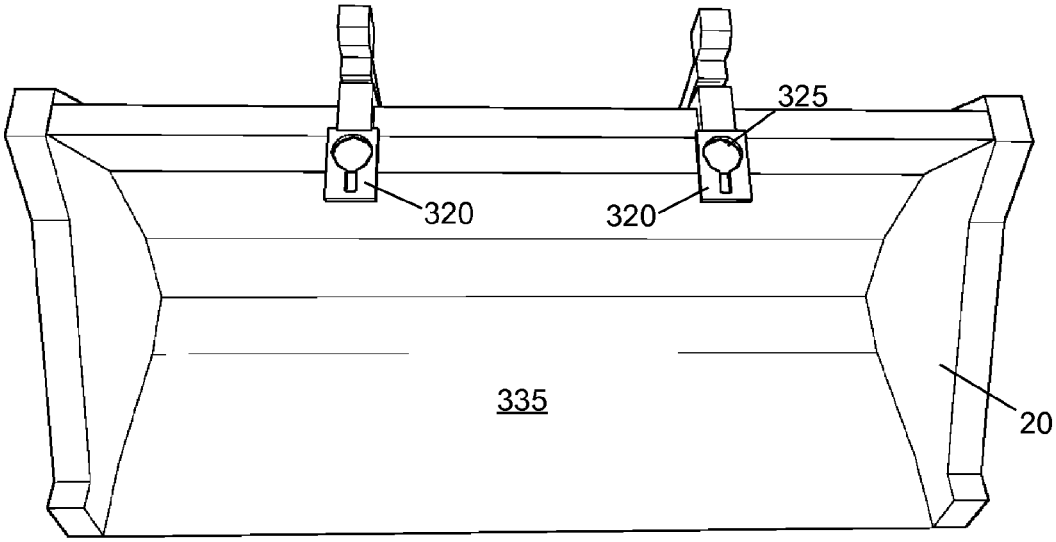
FIG. 64 shows a rear perspective view of bucket having chain hooks oriented to interconnect with the upper pins of lifting arm couplers.

FIGS. 61-63 illustrate another example of lift arms 15 cantilevered upon an implement 20. In FIGS. 61-63 the implement includes a plurality of hole plates 320 that have holes 325 interconnected with the upper portion of the implement. The holes 325 are structured so that the upper pins 330 of the connectors 50 may be inserted through the holes. Additionally, the holes may be shaped in a keyhole formation such that they are able to act as a chain hook when the implement and loader arms are in an operational configuration. When the upper pins 330 are interconnected with the holes, the weight of the lift arms 15 acts to press the bottom portions of the connectors 50 into the interior surface 335 of the implement 20. As shown in FIGS. 61 and 64 the weight of the lift arms is sufficient to keep the connectors securely pressed against the implement. FIG. 64 shows an example of a bucket having chain hook plates structured to secure a linked chain to the bucket or interconnect with the upper pins of a loader arm quick-connect coupler.

In the storage configuration shown in FIGS. 61-63 the lift arms do not extend overtop of the bucket so the connection process is simplified. First, since the interconnection point on the bucket is elevated, it is easier for the vehicle operator to determine if the lift arms are properly interconnected with the bucket. Secondly, the step of lowering the lift arms overtop of the bucket is eliminated.

Without the need to lower the lifting arms over the bucket, smaller loaders attached to large buckets, vehicles with lifting arms attached at a low, or lifting arms that lack a downward curvature may be utilized with the storage configuration. In facilitating the use of the storage system by more designs of loaders, the stored quick-connect coupler is located within bucket such that the amount of precipitation, dirt, and debris exposed to the coupler is reduced.

Other alterations, variations, and combinations are possible that fall within the scope of the present invention. Although the preferred embodiments of the present invention have been described, those skilled in the art will recognize other modifications that may be made that would nonetheless fall within the scope of the present invention. Therefore, the present invention should not be limited to the apparatus and method described. Instead, the scope of the present invention should be consistent with the invention claimed below.

We claim:

1. An assembly comprising:

a first arm and an implement having an operational coupler, the first arm secured to a first vehicle connector for attachment to a tractor, a skid steer, or a vehicle, the first arm including an operational connector for securing the first arm to the operational coupler when the assembly is in an operational configuration, the assembly in a storage configuration comprising:

the implement having a first fastener and a first arm rest region; and the first arm, cantilevered above the implement, having a second fastener interconnecting with the first fastener to form a fulcrum about which the arm pivots relative to the implement, a portion of the first arm resting against the first arm rest region of the implement, and the operational coupler is disconnected from the operational connector.

2. The assembly of claim 1 in the storage configuration wherein the first fastener is located below the first arm rest region.

3. The assembly in the storage configuration of claim 2 wherein both the operational connector and the operational coupler are part of a quick-connect system.

4. The assembly of claim 2 in the storage configuration wherein the second fastener of the first arm is secured to the operational connector.

5. The assembly of claim 1 in the storage configuration wherein the implement has both a first side and a second side, the first arm rest region is located on the first side, and the first arm extends over the second side and away from the first side of the implement to balance the first arm over the implement in a stable position for storage.

6. The assembly of claim 1 in the storage configuration further comprising the implement having a third fastener and a second arm rest region;

a second arm, cantilevered above the implement, having a second vehicle connector and a fourth fastener interconnecting with the third fastener to form a pivot point about which the second arm pivots relative to the implement, a portion of the second arm resting against the second arm rest region of the implement.

7. The assembly of claim 1 in the storage configuration wherein the implement is a bucket having an open-face and a plurality of bucket teeth located on the perimeter of the open-face; and at least one of the plurality of bucket teeth is the first fastener.

8. The assembly of claim 1 in the storage configuration wherein the implement is a bucket having an open-face and a plurality of holes located about perimeter of the open-face; and at least one of the holes is the first fastener.

9. A boom and attachment assembly comprising a lifting arm and an implement, the assembly transformable from an operational configuration for raising and lowering the implement via the lifting arm secured to a vehicle to a storage configuration for storing the lifting arm in a cantilevered arrangement, the assembly comprising:

the lifting arm including a lift cylinder for raising and lowering the lifting arm, a first end with a vehicle fastener, and a second end with an operational fastener and a storage fastener;

the implement including a rest region located above a storage connector, and an operational connector;

in the operational configuration, the assembly includes the vehicle fastener secured to the vehicle, and the operational fastener secured to the operational connector; and in the storage configuration, the assembly includes the storage fastener interconnected with the storage connector, and the lifting arm supported in a cantilevered configuration above the implement by the rest region, the storage fastener, and the storage connector.

10. The assembly of claim 9 wherein the implement has a base side and both a first side and a second side extending upwards from the base side, the rest region is located on the first side, and the arm extends over the second side and away from the first side of the implement to balance the arm over the implement in a stable position for storage.

11. The assembly of claim 10 wherein one of the base side, the first side, and the second side of the implement is an open-face of a bucket.

12. The assembly of claim 9 wherein in the operational configuration the storage fastener is separated from the storage connector, and in the storage configuration the operational fastener is separated from the operational connector.

13. The assembly of claim 9 wherein the storage fastener includes a hook; and the storage connector is a device selected from a group consisting of a clasp, an O-ring, a T-bar, a storage bar, a hole in the implement, and a bucket tooth secured to the implement.

14. The assembly of claim 9 wherein the rest region is located in a hole of the implement, the storage connector of the implement is an interior surface of a bucket, and the storage fastener of the lifting arm is a lower portion of a coupler.

15. A method of transforming the assembly of claim 9 from the operational configuration to the storage configuration, the method comprising the steps of:

detaching the operational fastener from the operational connector to disconnect the implement from the lifting arm;

repositioning the lifting arm relative to the implement while the implement is disconnected from the lifting arm;

connecting the storage fastener to the storage connector to reconnect the implement to the lifting arm;

resting the lifting arm upon the implement to balance the lifting arm over the implement in a stable position for storage; and disconnecting the lifting arm from the vehicle.

16. A method for transforming an implement with a storage connector and an operational connector, an arm with a storage fastener and an operational fastener, and a vehicle from an operational configuration to a storage configuration, the method comprising:

lowering the implement to a ground surface;

disconnecting the operational connector and the operational fastener to separate the implement from the arm;

repositioning the arm relative to the implement while the implement is disconnected from the arm;

connecting the storage fastener and the storage connector to re-connect the implement to the arm;

resting the arm upon the implement; and disconnecting the arm from the vehicle such that the arm is stored in a cantilevered configuration.

17. The method of claim 16 wherein the implement is a bucket that supports the weight of the arm when the implement, arm, and vehicle are in a storage configuration.

18. The method of claim 16 wherein the arm includes a tower, the vehicle includes a bracket, the tower and bracket are secured together when the implement, arm, and vehicle are in the operational configuration, and in the storage configuration the tower and bracket are at substantially the same elevation and the arm extends unsupported from the implement to the tower.

19. The method of claim 16 wherein the arm includes a tower;

the vehicle includes a bracket;

the tower and bracket are connected together when the implement, arm, and vehicle are in the operational configuration;

in the storage configuration, the tower and bracket are at the same elevation and the arm extends unsupported from the implement to the tower; and the repositioning step includes wrapping the arm around the implement to position the storage fastener near the storage connector.

20. The method of claim 16 wherein the repositioning step includes wrapping the arm around the implement to position the storage fastener near the storage connector.

21. The method of claim 16 wherein the storage connector includes an object selected from a group consisting of a clasp, an O-ring, a T-bar, a storage bar, a hole in the implement, a chain hook eyelet, and a bucket tooth secured to the implement.

22. The method of claim 16 wherein the connecting the storage fastener step includes the storage fastener interconnecting with the storage connector to form a fulcrum about which the arm pivots relative to the implement, and the resting step includes pivoting the arm about the fulcrum to rest the arm upon the implement.

23. A method for storing a boom arm assembly, the boom arm assembly initially being attached to a utility vehicle at the back end of the boom arm assembly and having an implement attached to the front end of the boom arm assembly, the method comprising the steps of:

detaching the front end of the boom arm assembly from the implement;

moving the utility vehicle to locate the boom arm assembly over a stationary object so that the front end of the boom arm assembly extends over a first side of the stationary object and the back end of the boom arm assembly extends over a second side of the stationary object, the stationary object further having a connector located on the first side of the stationary object;

lowering the boom arm assembly to interconnect the front end of the boom arm assembly with the connector on the first side of the stationary object;

further lowering the boom arm assembly to place the boom arm assembly in contact with the first side of the stationary object;

detaching the back end of the boom arm assembly from the utility vehicle;

moving the utility vehicle to leave the boom arm assembly interconnected with the stationary object and in a stable position for storage.

24. The method of claim 23 wherein the stationary object is the implement that was detached from the front end of the boom arm assembly.

25. The method of claim 24 further comprising the step of flipping over the implement while the implement is disconnected from the boom arm assembly.

26. The method of claim 24 wherein the implement is a device selected from a group consisting of a bucket, a pinching finger set, a hay handling structure, and a plow.

27. The method of claim 24 further comprising the step of repositioning the boom arm relative to the implement while the implement is disconnected from the boom arm.

28. A boom arm assembly for attachment to a utility vehicle, the boom arm assembly comprising:

a first boom arm having a back end, the back end of the first boom arm having a first utility vehicle connector, and a front end, the front end of the first boom arm having a first implement connector and a first storage connector;

a second boom arm having
a back end,
the back end of the second boom arm having a second utility vehicle connector, and
a front end,
the front end of the second boom arm having
a second implement connector and
a second storage connector;
an implement having
a back side with a first storage coupling and a second storage coupling; and
a front side,
having
a first boom arm coupling, and
a second boom arm coupling;
the boom arm assembly becoming operable by the utility vehicle by attaching the first and second utility vehicle connectors to the utility vehicle and
attaching the implement to the first and second boom arms by interconnecting
the first implement connector of the first boom arm with the first boom arm coupling of the implement and
the second implement connector of the second boom arm with the second boom arm coupling of the implement so that the first and second boom arms are connected to and extend from the back side of the implement for operation of the implement;
the boom arm assembly further becoming storable by
detaching the implement from the first and second boom arms by disconnecting the first and second implement connectors from the first and second boom arm couplings,
interconnecting
the first storage connector of the first boom arm with the first storage coupling of the implement and
the second storage connector of the second boom arm with the second storage coupling of the implement
so that the first and second boom arms are connected to the back side of the implement but extend over and away from the front side of the implement to balance the first and second boom arms over the implement in a stable position for storage,
detaching the first and second utility vehicle connectors from the utility vehicle.

29. The boom arm assembly of claim 28 wherein
the first storage connector extends from the first implement connector towards the second boom arm; and
the second storage connector extends from the second implement connector towards the first boom arm.

30. The boom arm assembly of claim 28 wherein
the first storage coupling is a device selected from a group consisting of a clasp, an O-ring, a T-bar, a storage bar, a hole in the implement, and a bucket tooth.

31. The boom arm assembly of claim 28 wherein
the stored boom arm assembly includes
the first and second boom arms cantilevered above the implement,
the first boom arm rests upon a first arm rest area of the implement, the first arm rest area is located above both the first storage connector and the first storage coupler, and
the second boom arm rests upon a second arm rest area of the implement, the second arm rest area is located above both the second storage connector and the second storage coupler.

* * * * *